United States Patent [19]

Koumura et al.

[11] Patent Number: 4,464,043

[45] Date of Patent: Aug. 7, 1984

[54] AUTOMATIC PRINTING APPARATUS

[75] Inventors: Noboru Koumura, Narashino; Toshiyuki Komatsu, Kawasaki; Katsumi Nakagawa, Tokyo; Nobuhiro Takekawa, Tokyo; Motoharu Fujii, Tokyo, all of Japan

[73] Assignee: Canon Kabushiki Kaisha, Tokyo, Japan

[21] Appl. No.: 131,497

[22] Filed: Mar. 18, 1980

Related U.S. Application Data

[60] Division of Ser. No. 7,628, Jan. 29, 1979, Pat. No. 4,255,041, which is a continuation of Ser. No. 794,661, May 6, 1977.

[30] Foreign Application Priority Data

May 17, 1976 [JP] Japan ..... 51-56263

[51] Int. Cl.[3] ..... G03G 15/00

[52] U.S. Cl. ..... 355/14 C

[58] Field of Search ..... 355/14 C, 14 R, 3 R

[56] References Cited

U.S. PATENT DOCUMENTS 3,944,360 3/1976 Deetz et al. ..... 355/14 C 4,062,061 12/1977 Batchelor et al. ..... 355/14 C

*Primary Examiner*—R. L. Moses

*Attorney, Agent, or Firm*—Fitzpatrick, Cella, Harper & Scinto

[57] ABSTRACT

An automatic printer includes an accommodation device for an image forming element used for forming a master adapted to be repeatedly subjected to a reproduction process, and an optical system for projecting an image of the original onto the image forming element. A heater is provided for heating the image forming element for generating an electrostatic pattern in accordance with the image formed on the image forming element by the optical system, and the printer includes a rotary member for holding a master prepared by the optical system and the heating means, and a master holder for holding the leading end of the master on the rotary member. A charger is disposed for forming an electrostatic image corresponding to the original image on the master held on the rotary member, and a developer device and a transfer device are provided visualizing the electrostatic image, and transferring the visible image formed on the master by means of the developer onto a recording element. The image forming element which is subjected to the projection of an image of an original by the optical system is heated by the heater to obtain the master, and the master is maintained on the rotary member and repeatedly subjected to the step to be conducted by the charger, the developer and transfer device.

26 Claims, 39 Drawing Figures

| FIG. 2A | FIG. 2B |
|---|---|

84
87
82
TH2
55
9
85
88
81
86
US1
83
51
79
73
48
44
50
PH7
43
77
75
P
VS3
8
69
68
PH5
80
37
74
HAL3
HAL4
76
PH6
HAL1
HAL3
78
49
M
39
58
41
72
HAL2
69
PH4
42
71
46
60
59
62
61
63
PH8
PH11
47a
47b
US2
66
64
65
52
38

| FIG. 5A |
| --- |
| FIG. 5B |

FIG. 6-a
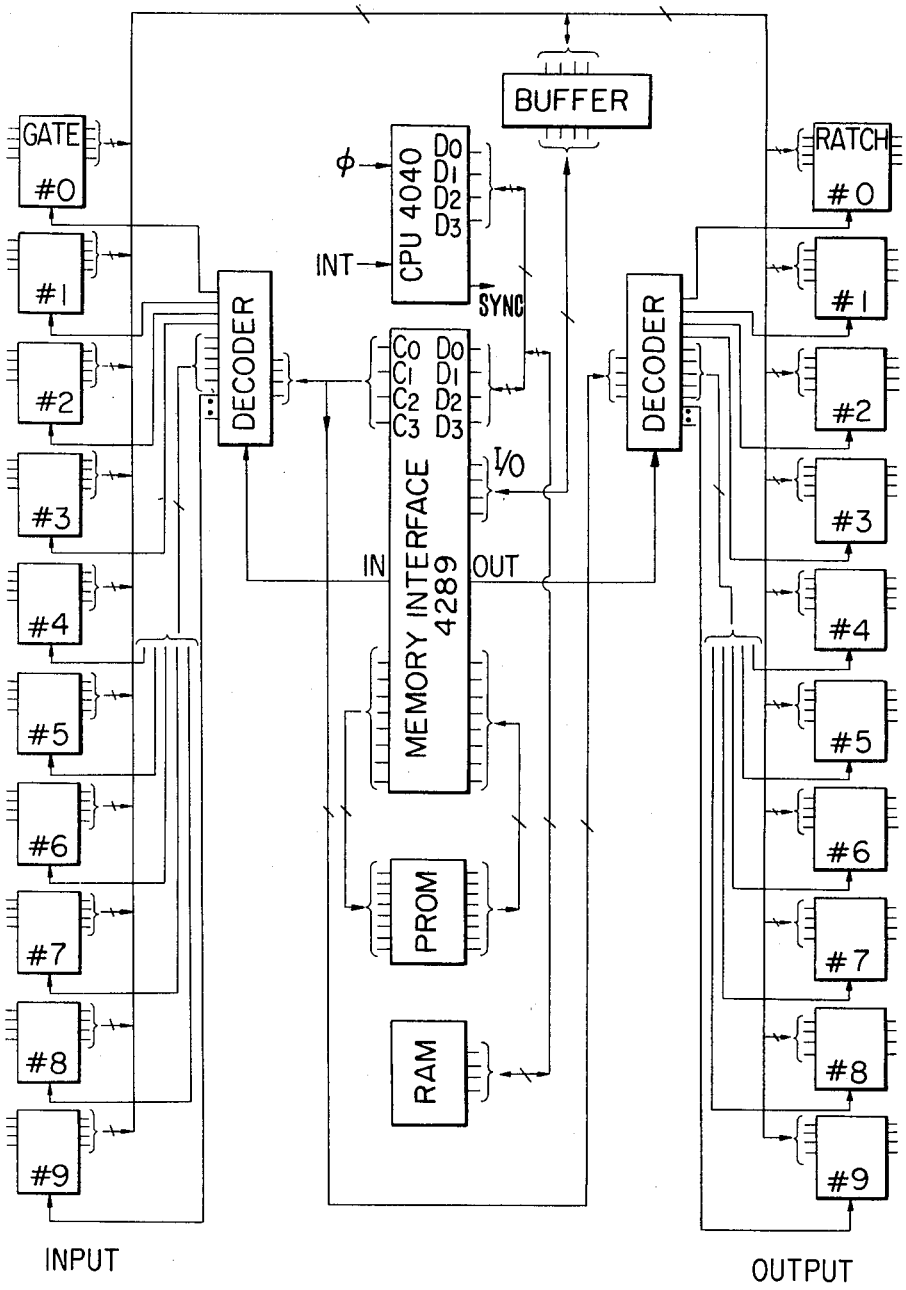

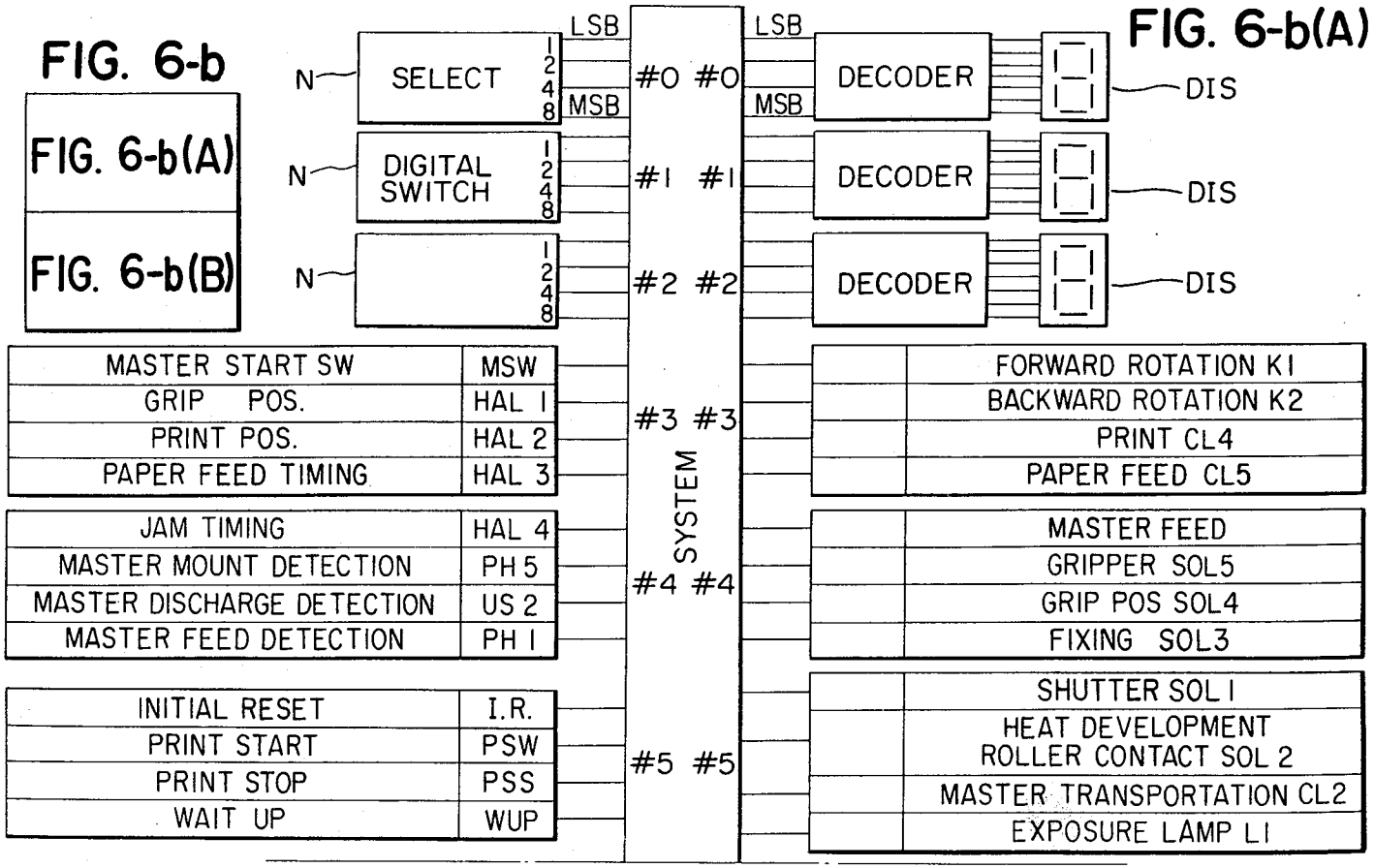
FIG. 6-b
FIG. 6-b(A)
FIG. 6-b(B)
N
SELECT
DIGITAL SWITCH
LSB
MSB
1 2 4 8
#0 #1 #2 #3 #4 #5
SYSTEM
DECODER
DIS
MASTER START SW
GRIP POS.
PRINT POS.
PAPER FEED TIMING
MSW
HAL 1
HAL 2
HAL 3
JAM TIMING
MASTER MOUNT DETECTION
MASTER DISCHARGE DETECTION
MASTER FEED DETECTION
HAL 4
PH 5
US 2
PH 1
INITIAL RESET
PRINT START
PRINT STOP
WAIT UP
I.R.
PSW
PSS
WUP
FORWARD ROTATION K1
BACKWARD ROTATION K2
PRINT CL4
PAPER FEED CL5
MASTER FEED
GRIPPER SOL5
GRIP POS SOL4
FIXING SOL3
SHUTTER SOL 1
HEAT DEVELOPMENT ROLLER CONTACT SOL 2
MASTER TRANSPORTATION CL2
EXPOSURE LAMP L1

FIG. 6-b(B)
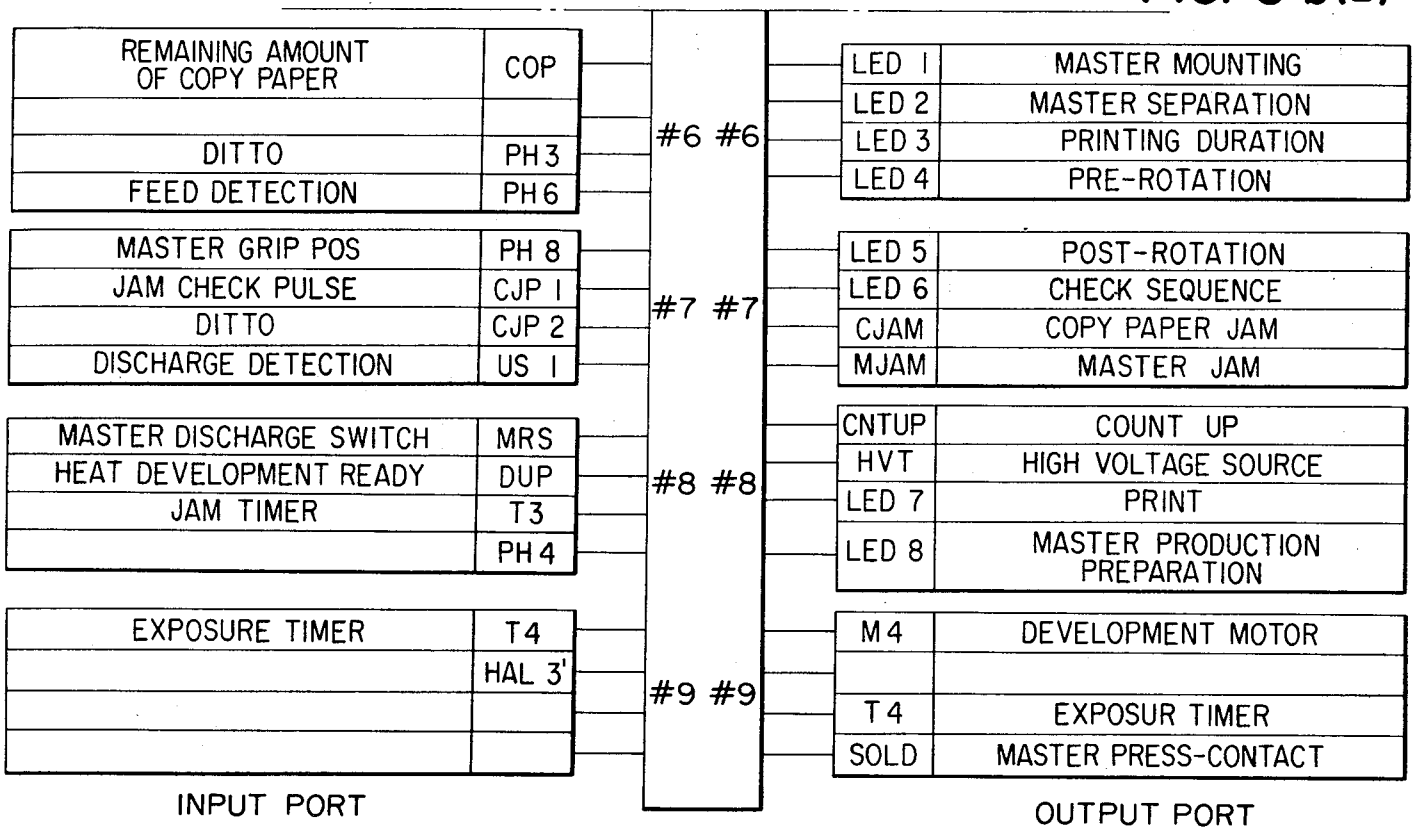

(4 BIT)
INTERNAL DATA BUS
STACK MULTIPLEXER
REGISTER MPX
STACK POINTER
PROGRAM COUNTER (12)
LEVEL No. 1
LEVEL No. 2
LEVEL No. 3
LEVEL No. 4
LEVEL No. 5
LEVEL No. 6
LEVEL No. 7
ADDRESS STACK
INDEX BANK 0
INDEX BANK 1
0 (4)
1
2
3
4
5
6
7
8
9
10
11
12
13
14
15
SCRATCH PAD
RESET

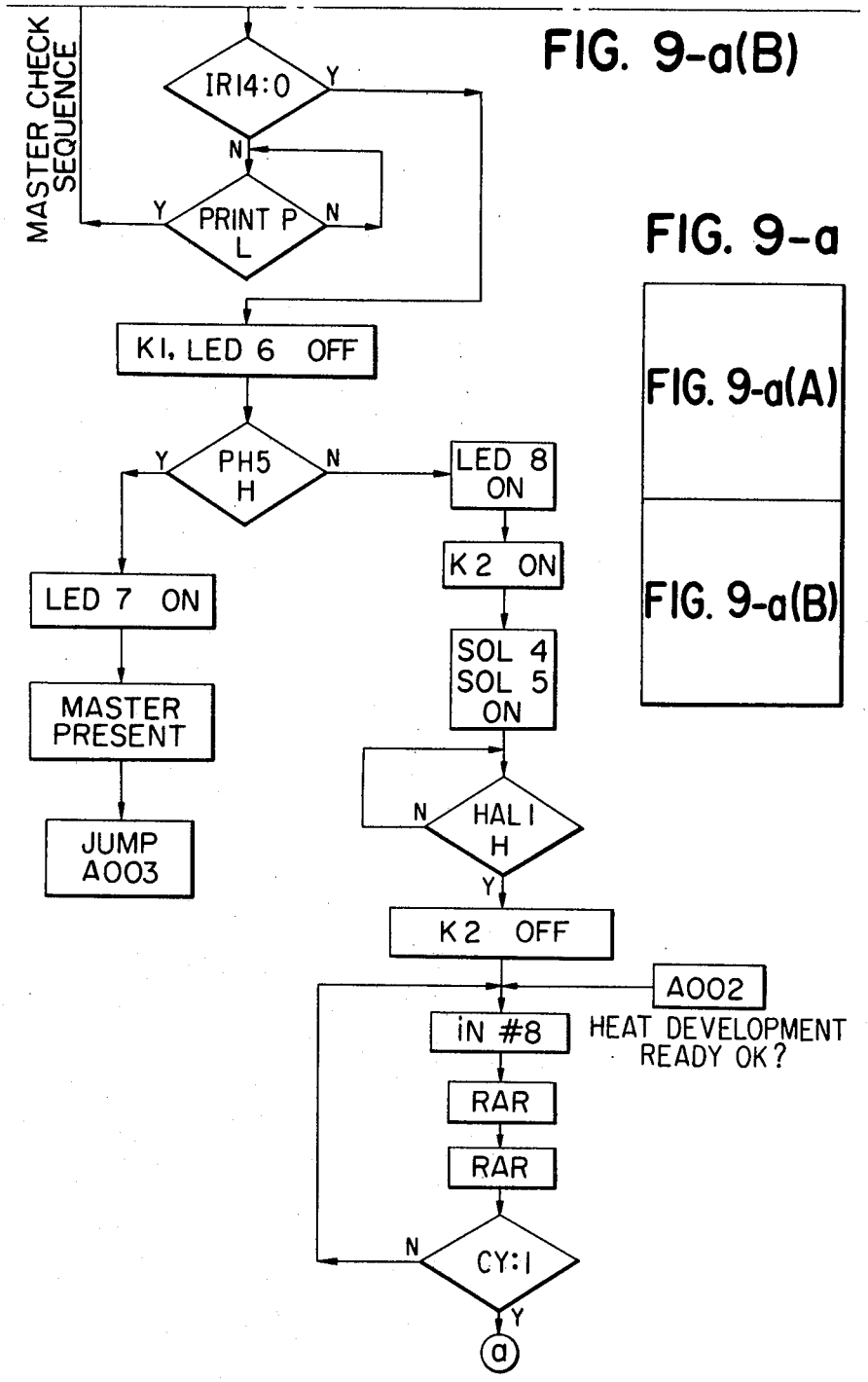
FIG. 9-a
FIG. 9-a(A)
FIG. 9-a(B)

FIG. 9-a(A)
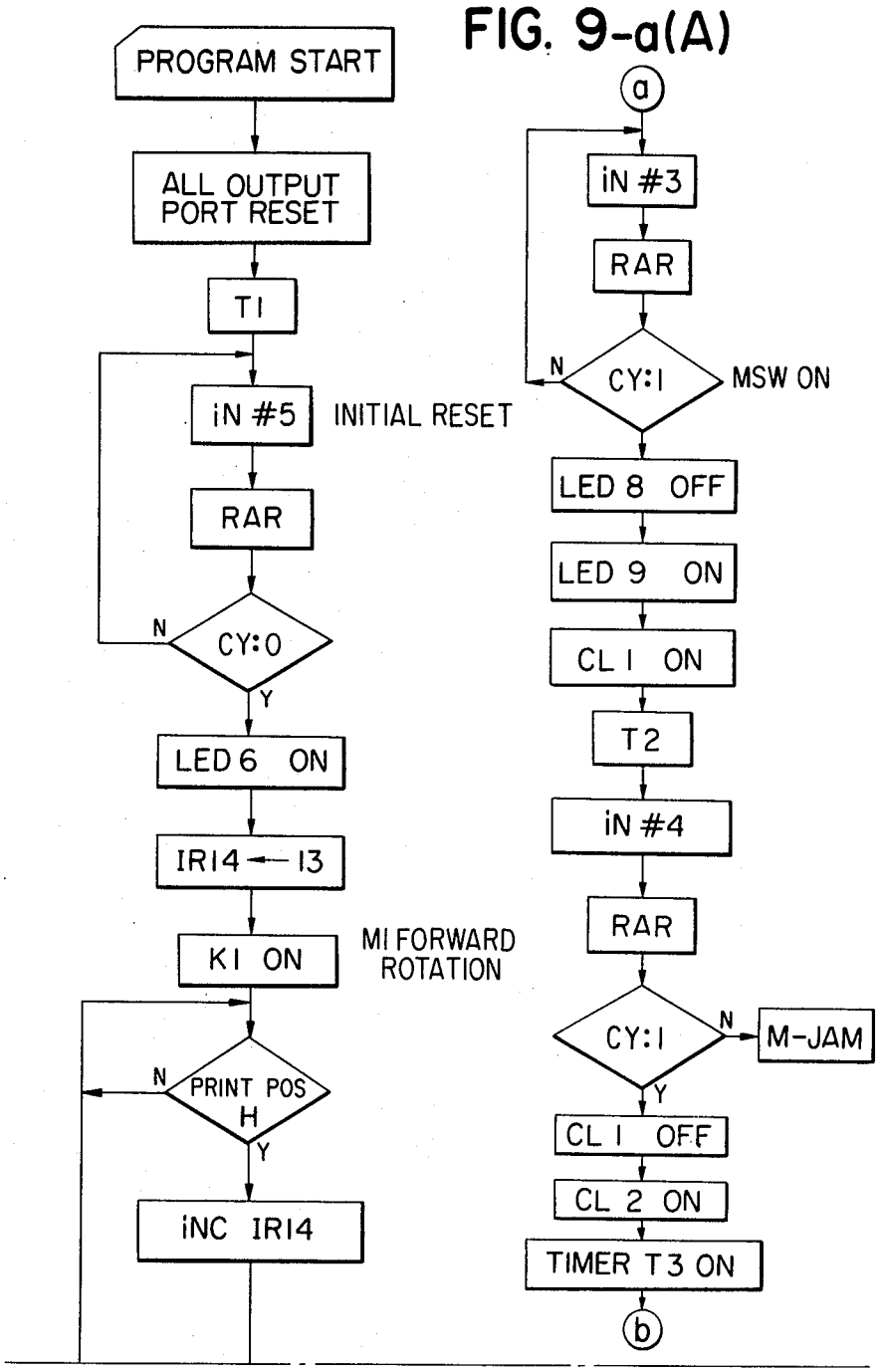

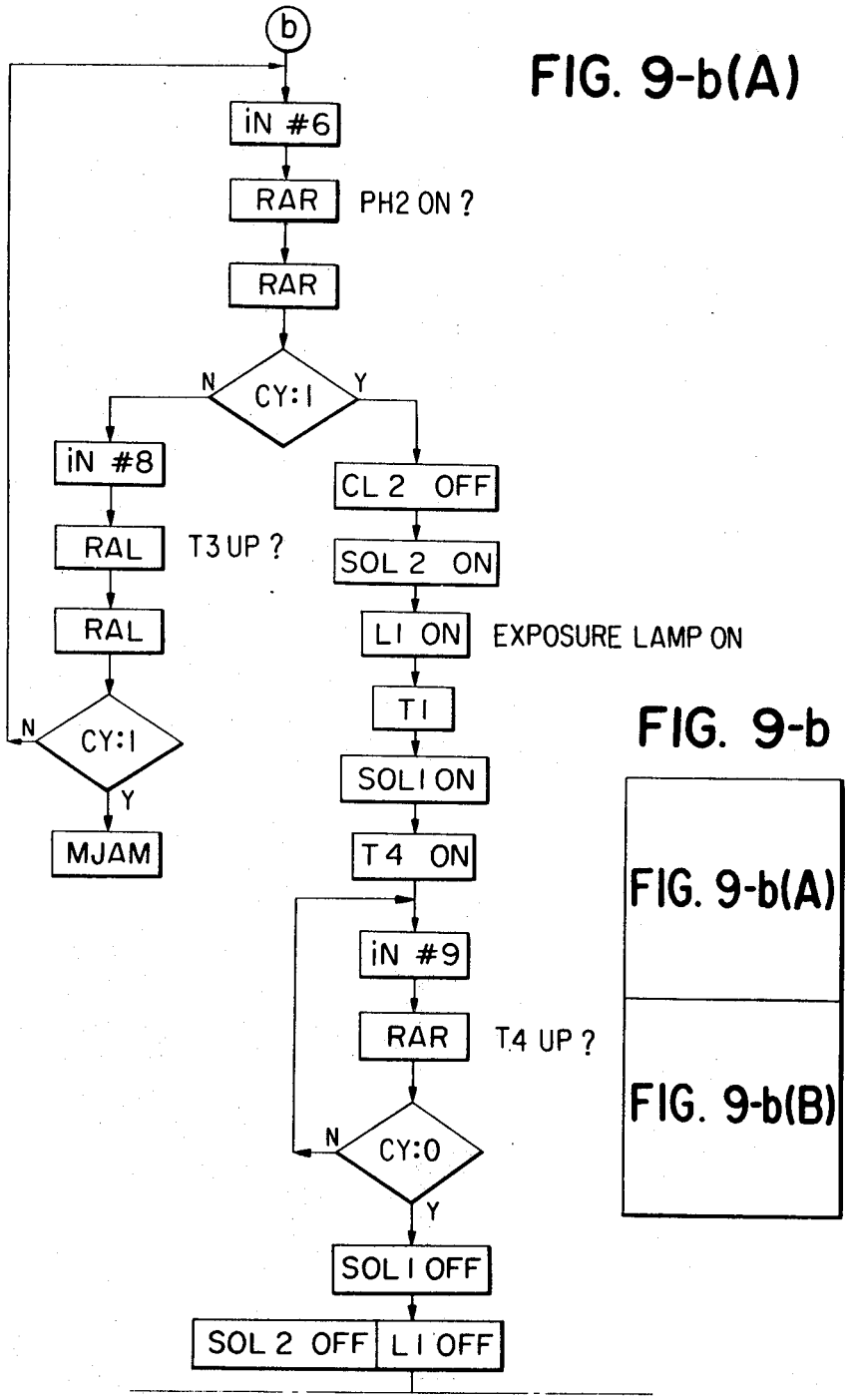
FIG. 9-b(A)
FIG. 9-b

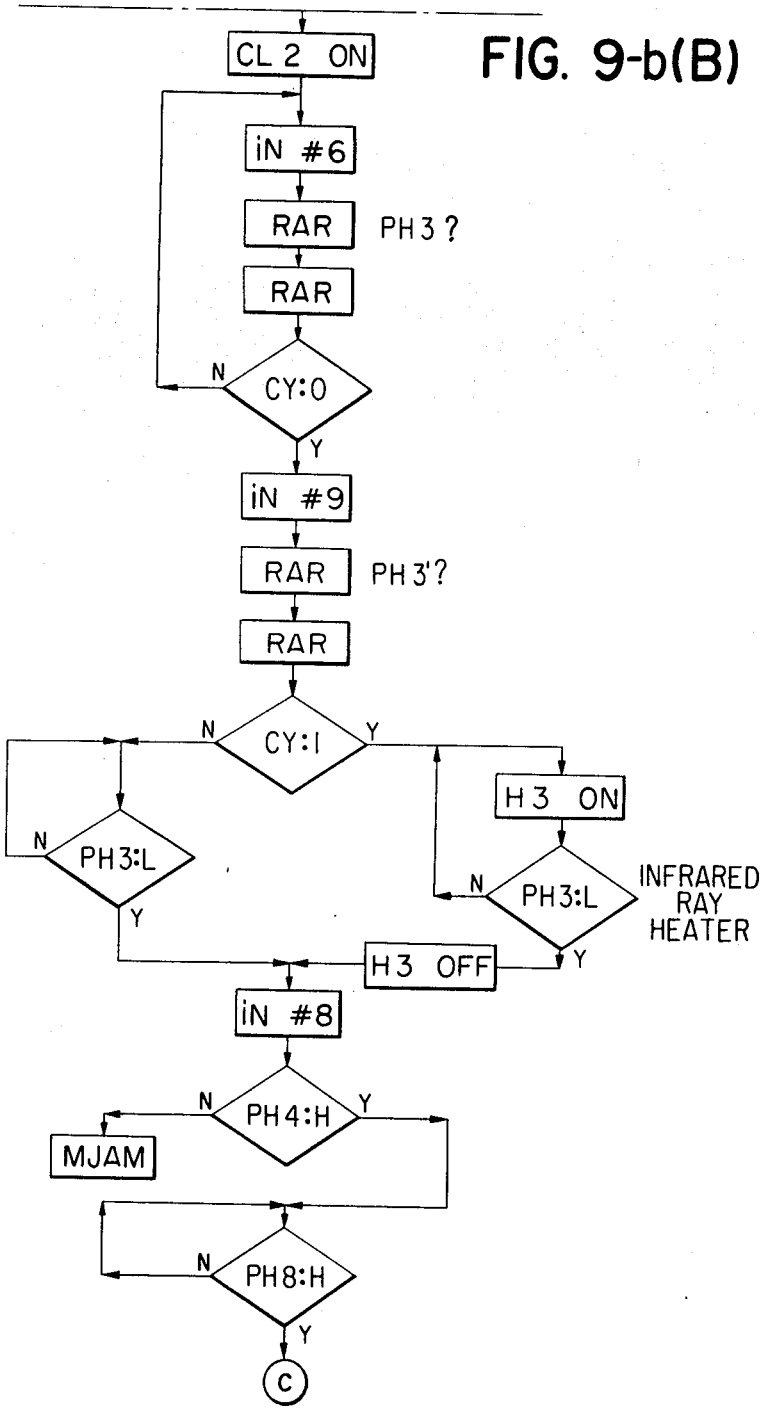
FIG. 9-b(B)

FIG. 9-c(A)
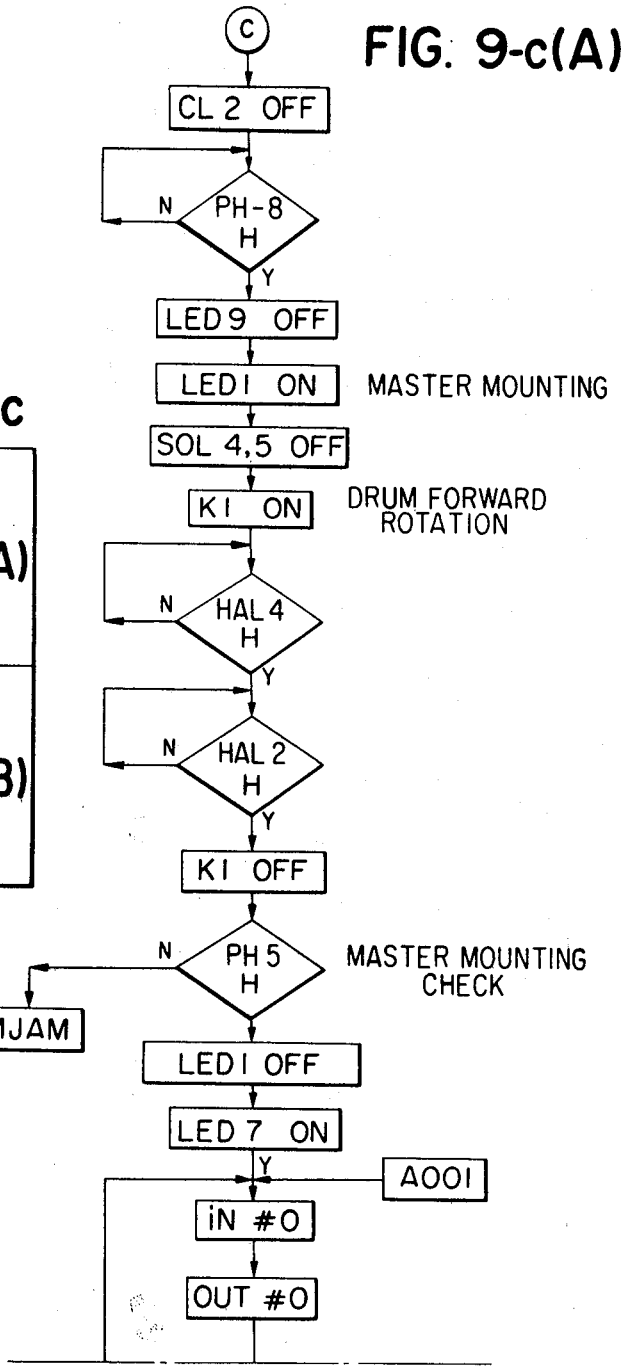
FIG. 9-c
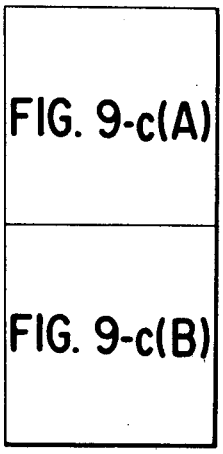

FIG. 9-c(B)
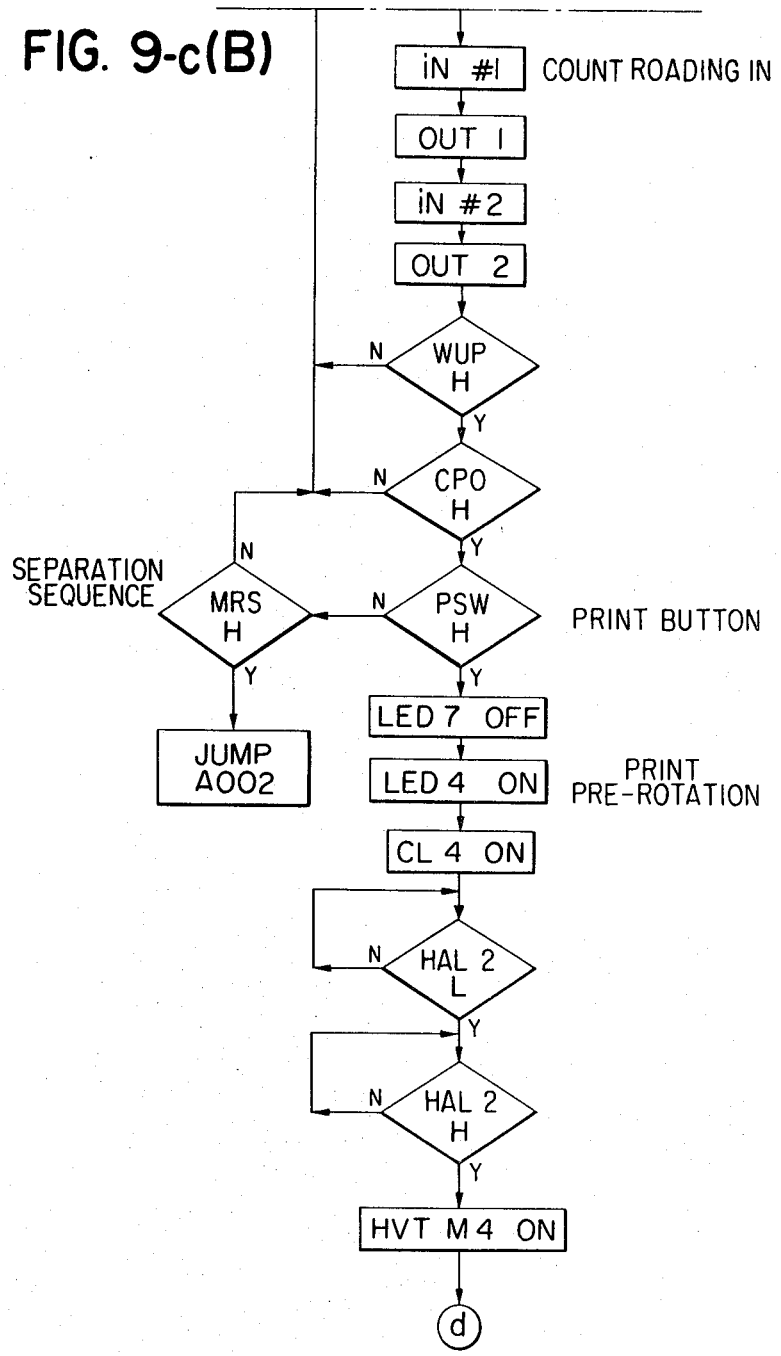

FIG. 9-d(A)
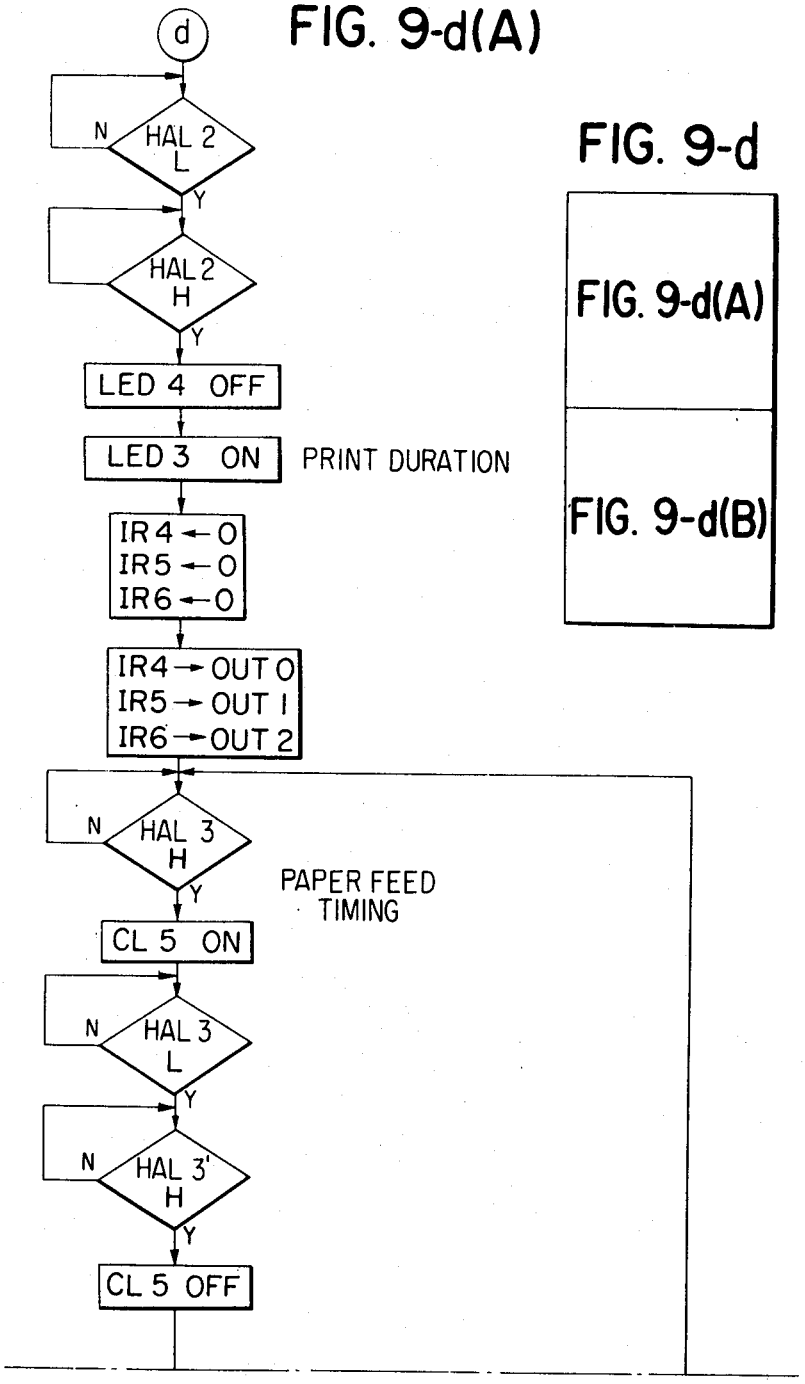
FIG. 9-d

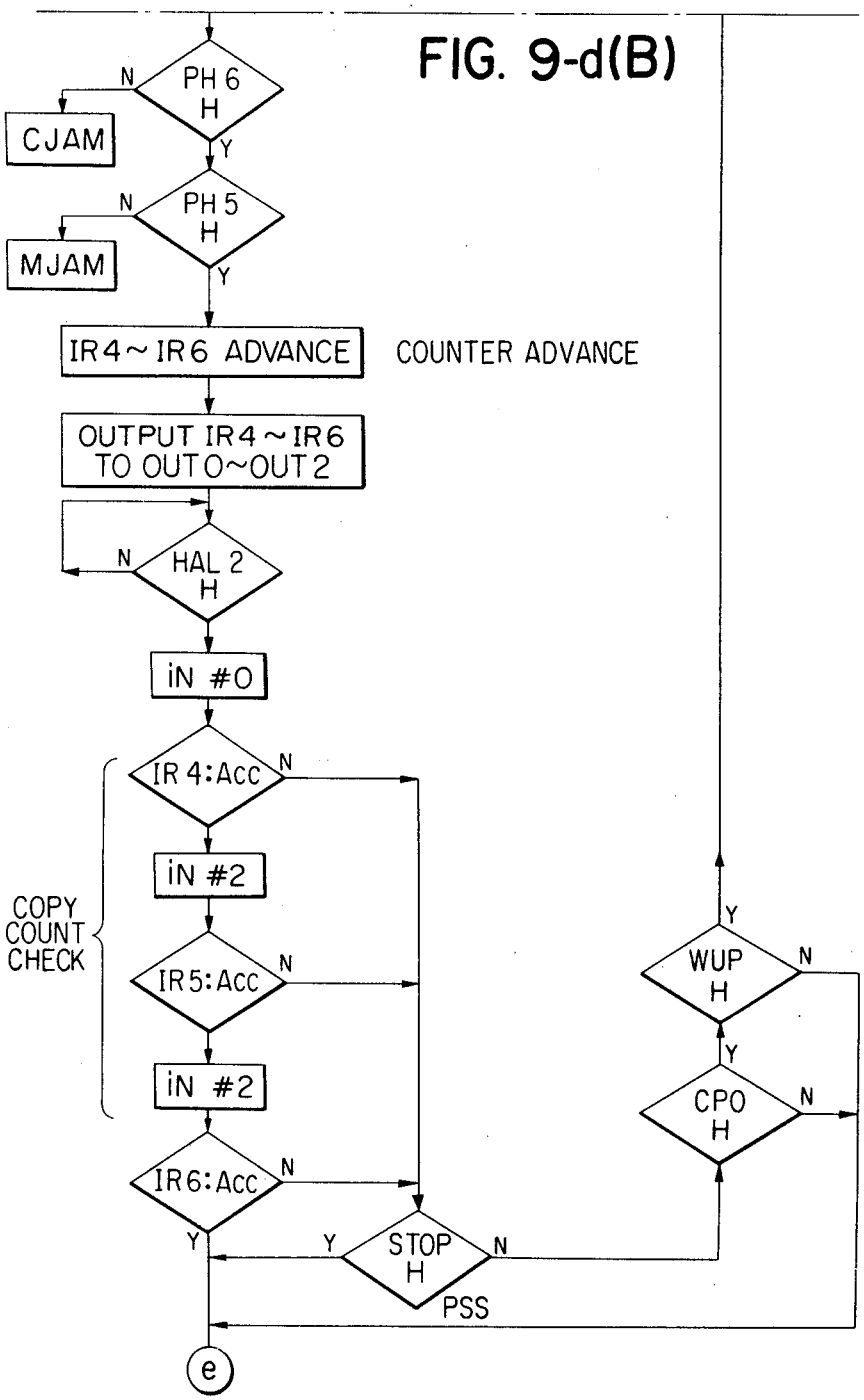
FIG. 9-d(B)
PH 6 H
N
CJAM
Y
PH 5 H
N
MJAM
Y
IR4~IR6 ADVANCE
COUNTER ADVANCE
OUTPUT IR4~IR6 TO OUT0~OUT2
HAL 2 H
N
iN #0
IR 4:Acc
N
iN #2
COPY COUNT CHECK
IR5:Acc
N
iN #2
IR6:Acc
N
Y
STOP H
Y
N
PSS
WUP H
Y
N
CPO H
Y
N
e

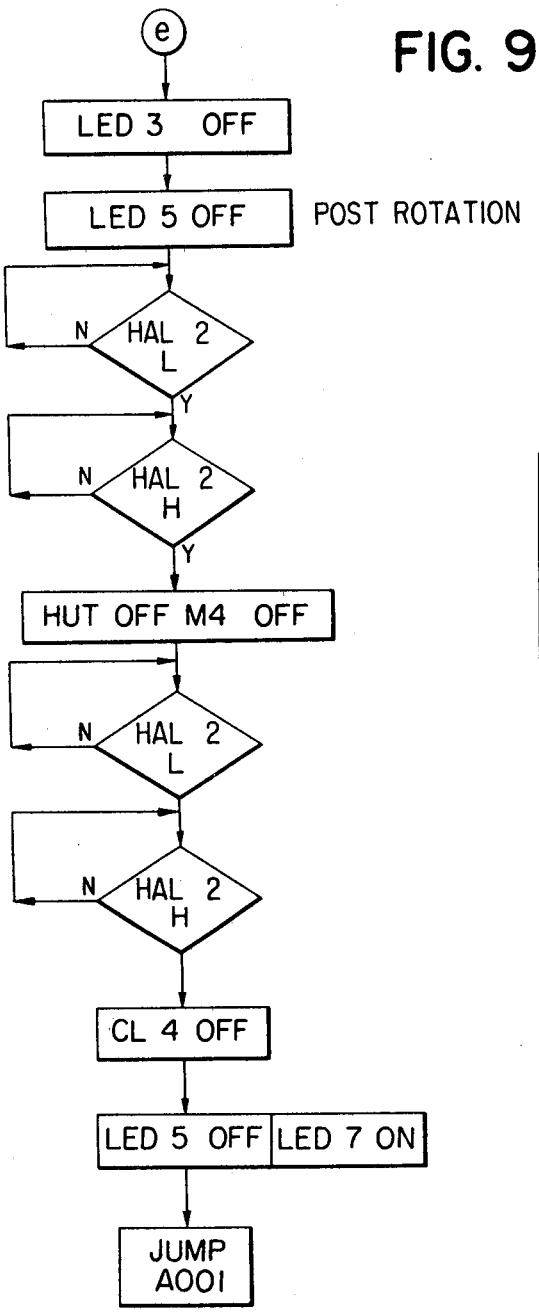
FIG. 9-e(A)
FIG. 9-e
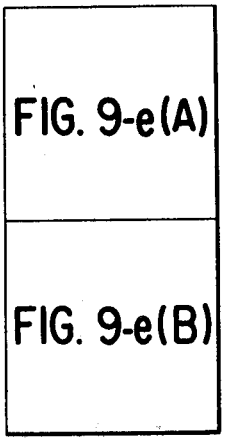

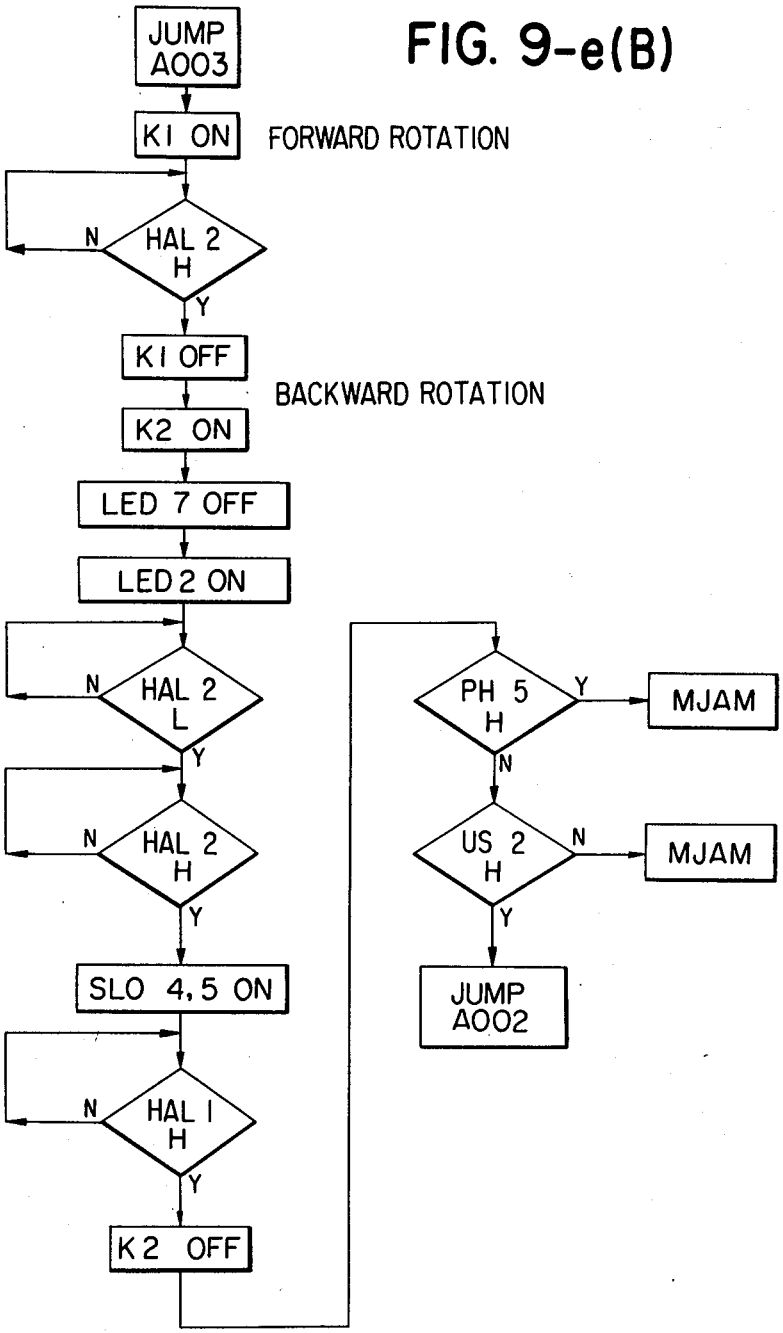
FIG. 9-e(B)
JUMP A003
K1 ON
FORWARD ROTATION
HAL 2 H
N
Y
K1 OFF
BACKWARD ROTATION
K2 ON
LED 7 OFF
LED 2 ON
HAL 2 L
HAL 2 H
SLO 4, 5 ON
HAL 1 H
K2 OFF
PH 5 H
MJAM
US 2 H
JUMP A002

FIG. 9-f
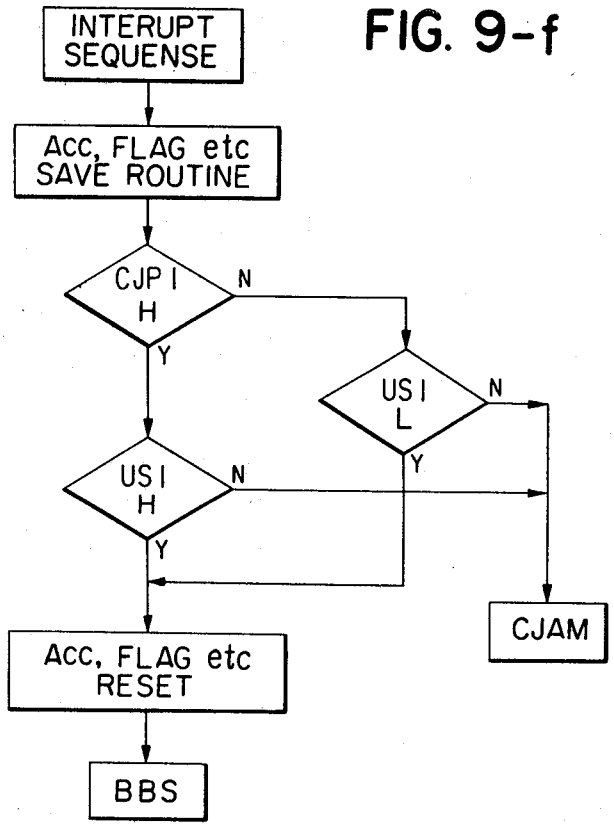
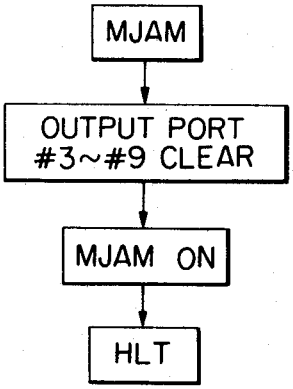
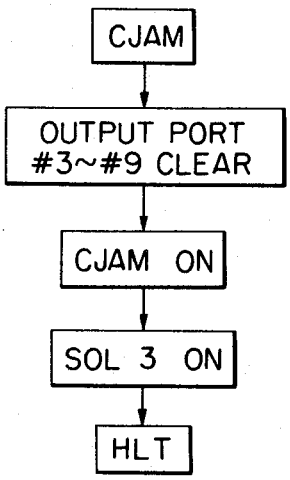

(a)

(b)

(c)

AUTOMATIC PRINTING APPARATUS

This is a division of application Ser. No. 007,628, filed Jan. 29, 1979 now U.S. Pat. No. 4,255,041, which was a continuation application of Ser. No. 794,661 filed May 6, 1977.

BACKGROUND OF THE INVENTION

1. Field of the Invention

This invention relates to an automatic printing apparatus, and more particularly to an automatic printing apparatus capable of automatically conducting an integrated printing process in continuous manner from the step of forming an image pattern adapted to be repeatedly subjected to an image reproducing process on an image forming element (which is herein defined as an element adapted to receive such image pattern) to obtain a printing master (which is herein defined as an image forming element holding thereon such image pattern), to the printing step.

2. Description of the Prior Art

The present so-called information age is characterized by the multiplicity of the means of information communication, among which the document duplication as a means for transmission of business information not only shows an ever-increasing tendency in the quantity and total expenditure of copying but also is constantly exposed to strong demands from the users for higher copying speed and copying quality, and there has therefore been desired the development of an apparatus for reproducing the image of an original document with a higher speed, a rapid access, a high reliability and an easy maintenance.

Attempting to satisfy such demands there have been proposed various apparatus in the copying and printing fields. Among such apparatus there is already known a printing apparatus provided with an image reproducing station capable of conducting an image reproducing process such as an electrostatic printing process in order to reproduce an original document on a paper sheet or the like.

Such known printing apparatus is ordinarily provided with a master preparing station and plural processing stations certain unit steps such as electrostatic charging, image development, image transfer and image fixing required in the image reproducing process.

In such printing apparatus there is employed a printing master consisting for example of an electroconductive substrate holding thereon an image pattern of an insulating material such as a synthetic resin corresponding to the image of original document to be reproduced, or of a metallic substrate holding thereon such image pattern composed of a photoresist or a photopolymer, or a zinc oxide copying sheet holding thereon an image pattern of an insulating resin formed by a known electrographic process, said image pattern being adapted to be repeatedly subjected to an image reproducing process.

Such masters, however, require preparation processes of multiple steps which are generally complex and time-taking due for example to the use of wet treatment, and a printing apparatus comprising a station for conducting the preparation of such printing master is disadvantageous in lacking rapid access, rapid start, and operational easiness.

Also a printing apparatus utilizing a zinc oxide copying sheet for the printing master requires an elevated number of steps since the preparation of master necessitates the steps of charging, exposure, development and fixing, and also requires an increased dimension of the entire apparatus since the above-mentioned steps of master preparation cannot often be conducted in the processing station for conducting the steps of charging, development, transfer and fixing for electrostatic printing process but have to be conducted in a separate processing station for master preparation.

Furthermore the printing master composed of a zinc oxide copying sheet has a tendency to generate a background fog in the reproduced image due to the inevitable fog potential, and, in order to avoid this phenomenon, it becomes necessary to apply a flash exposure to the master prior to the development step in the electrostatic printing process or to employ a bias potential higher than the normal value at said development step. Also the presence of eventual unevenness in the electric resistance in the zinc oxide photosensitive layer or in the paper substrate results frequently in a corresponding unevenness in the optical density of reproduced image, particularly marked in the medium image density areas, and an additional measure has to be incorporated in order to prevent this phenomenon. The printing master as mentioned above is therefore disadvantageous in that the printing apparatus has to be provided with an additional processing station for conducting such additional measures under precise control.

Furthermore the above-mentioned printing master, wherein the image pattern is composed of a relief structure, has a limitation in the length of run since said relief structure, upon subjected to repeated electrostatic printing process, is damaged by mechanical friction to cause defects in the image pattern or uneven electrostatic charging, thus giving rise to deteriorated quality of reproduced image in proportion to the number of repetition of electrostatic printing process.

Furthermore, the printing apparatus as thus far explained requires a highly trained operator since considerable technical expertise is indispensable in the adjustment and operation of the processing station for the master preparation.

As explained in the foregoing, the known printing apparatus, being associated with the drawbacks in the adjustment and operation of the master preparation process and the processing station therefor and those of the printing master prepared by said process, have much to be improved in order to satisfy the demands of users.

SUMMARY OF THE INVENTION

An object of the present invention, therefore, is to provide an automatic printing apparatus of an elevated and versatile copying ability covering from copying of limited numbers to high-speed printing of multiple copies with a simple and rapid operation without the need for a trained operator.

Another object of the present invention is to provide an automatic grinding apparatus provided with a master processing station, a printing station and a control unit containing an image reproducing control means which controls, with a proper time-sequence, the various processing units performing the determined process steps to be executed in aforementioned stations.

Another object of the present invention is to provide an automatic printing apparatus provided with a master processing station performing the preparation of a printing master with a completely dry process.

Another object of the present invention is to provide an automatic printing apparatus wherein a printing master is prepared in a master processing station and is transferred and mounted in a printing station in which said master is subjected repeatedly to a printing process.

Another object of the present invention is to provide an automatic printing apparatus wherein the mounting of a master on a printing drum is performed upon detection that a leading end of said master has reached a master holding portion of said printing drum.

Another object of the present invention is to provide an automatic printing apparatus wherein the leading end of a master is detected by the deflection into the form of a loop, of said master.

Another object of the present invention is to provide an automatic printing apparatus wherein a printing master prepared by a thermal development of an image forming element is mounted on a rotary drum and subjected repeatedly and in continuous manner to a printing process.

Another object of the present invention is to provide an automatic printing apparatus wherein a master prepared by thermal development in a heating means is subjected to the detection of image density, and is subjected to a secondary heating according to the result of said detection thereby correcting the image to an appropriate density.

Another object of the present invention is to provide an automatic printing apparatus wherein the electrostatic charging step and the image transfer step are simultaneously conducted in a same position.

Another object of the present invention is to provide an automatic printing apparatus provided with a secondary charging unit which detects the charged state of a master and performs an electrostatic charging according to the result of said detection thereby correcting the charge state of the master.

Another object of the present invention is to provide an automatic printing apparatus wherein a master can be mounted on a rotary drum in such a manner that the leading end and trailing end of said master overlap each other.

Another object of the present invention is to provide an automatic printing apparatus wherein the leading end of a master is firmly fixed on the rotary drum while the trailing end of said master is maintained free on said rotary drum.

Another object of the present invention is to provide an automatic printing apparatus which can dispense with the cleaning means in the printing process.

Another object of the present invention is to provide an automatic printing apparatus wherein a cleaning means is intermittently actuated in the printing process.

Another and important object of the present invention is to provide an automatic printing apparatus wherein the rotation start position of the rotary drum at which the leading end of a master is supported by said rotary drum (first start position) is different from the rotation start position of the rotary drum for repeatedly subjecting said master to a printing process consisting of the steps of electrostatic charging, development and transfer (second start position).

Another object of the present invention is to provide an automatic printing apparatus wherein the rotary drum holding a master thereon is rotated from said first start position and stopped at said second start position which constitutes a stand-by state for the printing process.

Another object of the present invention is to provide an automatic printing apparatus wherein the rotary drum, after rotated from said second start position and repeatedly subjected to said printing process, is stopped at said first start position which constitutes a stand-by state for mounting a master of said rotary drum.

Another object of the present invention is to provide an automatic apparatus wherein the master is separated from said rotary drum by means of reverse rotation thereof.

Another object of the present invention is to provide an automatic printing apparatus wherein the execution of each of the processes of master preparation, master mounting, printing and master separation is indicated in successive order to facilitate the operation of the apparatus.

Another object of the present invention is to provide an automatic printing apparatus provided with an effective detecting method for the jamming of copy sheets transported at a high speed and in continuous manner.

Another object of the present invention is to provide an automatic printing apparatus incorporating additional special functions and characteristics such as a control of master processing, a size enlargement and reduction of reproduced image, an automatic detection of master adequacy, the control of at least one of plural units for conducting the electrostatic printing process in response to the signal of said detection, a detection as to whether a master can be mounted on a determined position in the printing station, a control of positional aberration of the master in response to the signal of said detection, a detection for erroneous advancement and jamming of the master, a control of the steps of electrostatic charging, development and fixing, a control for advancement of and detection of jamming and erroneous advancement of copy sheets, and a programmed control of print counting and print size change. These functions and characteristics are achieved, in combination with the eventually related process steps, by means of an electronic sequence control and a mechanical sequence control which are designed to function at appropriate timing.

The automatic printing apparatus of the present invention is provided with a master processing station adapted to perform the preparation of a master by means of a dry process and a printing station adapted to conduct an electrostatic printing process utilizing thus prepared master, and is featured by its ability to conduct the entire process from the master preparation to the printing in an automatic and continuous manner.

BRIEF DESCRIPTION OF THE DRAWING

FIG. 6 is an illustration of an example of the control circuit for use in the present invention;

FIGS. 9*a*–9*f* are control flow charts;

DESCRIPTION OF THE PREFERRED EMBODIMENT

Figure 1:
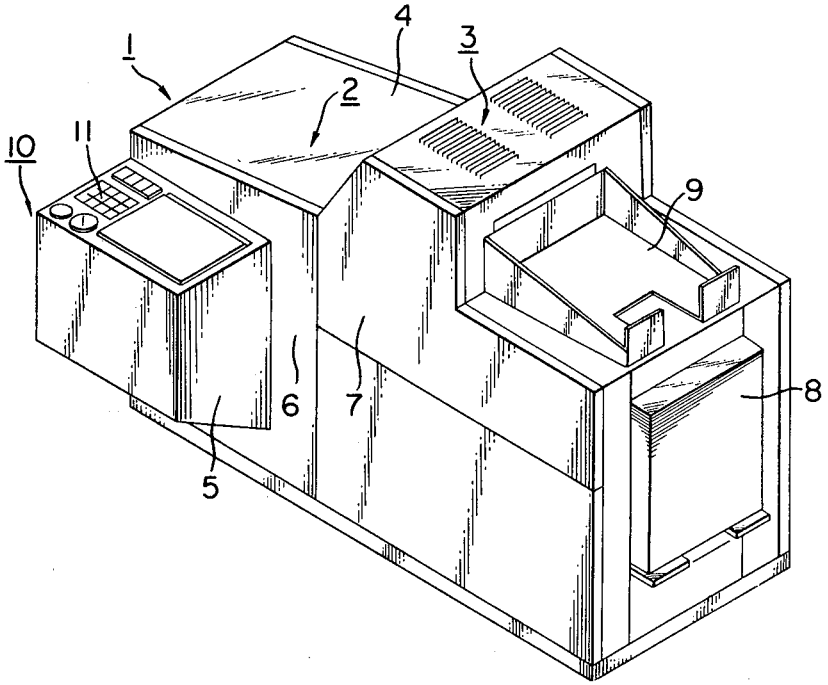
FIG. 1 is a perspective view of the automatic printing apparatus of the present invention.

Referring to FIG. 1, there is illustrated an automatic printing apparatus 1 embodying the present invention, which comprises a master processing station 2 for conducting the preparation of an electrostatic printing master and a printing station 3 for performing the electrostatic printing process. Said master processing station 2 comprises an image forming sheet holder 4 accommodating a plurality of image forming sheets S each of which is to be subjected to a master preparation process to obtain a printing master M, an exposure unit containing an exposure means for illuminating an original document placed at a determined exposure position and projecting the imagewise reflected light onto an image forming sheet S transported to and maintained standstill at a determined position, and a heat developing unit 6 containing a means for applying a heat development to thus exposed image forming sheet S, and is capable, in a completely automatic manner, of advancing an image forming sheet S from said image forming sheet holder 4 to a determined position, illuminating an original document to be reproduced which is placed in a determined focusing position and projecting the imagewise reflected light onto said image forming sheet S maintained at said determined position and applying a heat development to thus exposed image forming sheet.

Said printing station 3 is provided with an electrostatic printing unit 7 comprising an electrostatic printing means, and produces the reproduced image of said original document on a plurality of copy sheets in successive manner by repeatedly and continuously subjecting said master prepared in said master processing station 2 to an electrostatic printing process.

Said electrostatic printing unit 7 is provided with a charging unit for applying an electrostatic charging to said master thereby forming an electrostatic latent image thereon, a developing unit comprising a developing means for rendering said latent image visible, a transfer unit comprising a means for transferring the developed visible image on said master onto a transfer sheet P fed at an appropriate timing, and a fixing unit for fixing said visible image thus transferred onto said transfer sheet P.

Said transfer sheet P is fed from a transfer sheet stack 8 to said electrostatic printing unit 7, and the transfer sheet P provided thereon with a reproduced image, upon passing the final step of electrostatic printing process, is transferred from said electrostatic printing unit 7 to a transfer sheet receiver 9. At this position it is also possible to provide a sorter or collater, instead of or in combination with said receiver 9, in order to classify the transfer sheets P transferred in succession and to place them in multiple determined sections. The functions of various units in said master processing station 2 and printing station 3 are performed by a time sequence control, and the start, interruption, re-start, stopping and termination of the execution of such functions of said various units by said sequence control is partly controlled by a central control unit 10 comprising a control panel 11 provided with a plurality of control switches for performing the function of each unit and for programming a particular function for a particular processing unit, and also with a plurality of indicators for particular purposes or for indicating instructions to the operator.

Now referring to FIG. 2, there will be given an explanation in the following on the internal structure of the automatic printing apparatus 1 and the functions of various processing units thereof.

Said image forming sheet holder 4 is composed of a cassette 12 accommodating a determined number of image forming sheets and mounted in a determined position. In the illustrated embodiment the cassette 12 is inserted into a determined position in said holder 4 after a cassette panel 14 is pulled upwards around a hinge 13 thereof, and is securedly maintained in said position by means of a plate spring 15 mounted on the lower surface of said panel 14 upon closure thereof.

Upon receipt by the image forming sheet holder 4 of an execution signal for master preparation to be released by the central control unit 10, a feed roller 17 is activated according to a control signal from a master processing control unit 16 to separate an image forming sheet from the stack thereof in said cassette 12 and to cause advancement of said image forming sheet toward a pair of drive rollers 18*a*, 18*b*. Upon passing therebetween, said image forming sheet is further advanced through a guide 19 and another pair of drive rollers 20*a*, 20*b* to a focusing platform 21 which is included in said exposure unit 5 and to which the light is imagewise projected from an original document to be reproduced.

Said focusing platform 21 is provided with a translucent focusing plate 22 for satisfactorily focusing the light image from said original document onto thus transported image forming sheet and a pressure means 23 for applying a pressure on the rear surface of said image forming sheet thereby maintaining said sheet in intimate contact with the surface of said focusing plate 22. Said focusing plate 22 is preferably composed of a glass plate. Said pressure means 23 is composed of a plunger 24, arms 25*a*, 25*b*, springs 26*a*, 26*b*, and a pressure plate 27, whereby said plungers, arms and springs cooperate to apply a force to said pressure plate 27 toward said focusing plate 22 thereby maintaining the image forming sheet with the photosensitive side thereof facing ordinarily the light image coming from the original document in intimate contact with said focusing plate when said image forming sheet has been transported to a determined position on said focusing plate 22.

The image forming sheet thus maintained in contact with the focusing plate is then exposed to the light image, of a predetermined appropriate amount, coming through an optical path from the original document, and said image forming sheet thus exposed is then transported by means of a pair of drive rollers 28*a*, 28*b*, to the heat developing unit 6 for the succeeding heat developing process.

Figures 2, 2A:
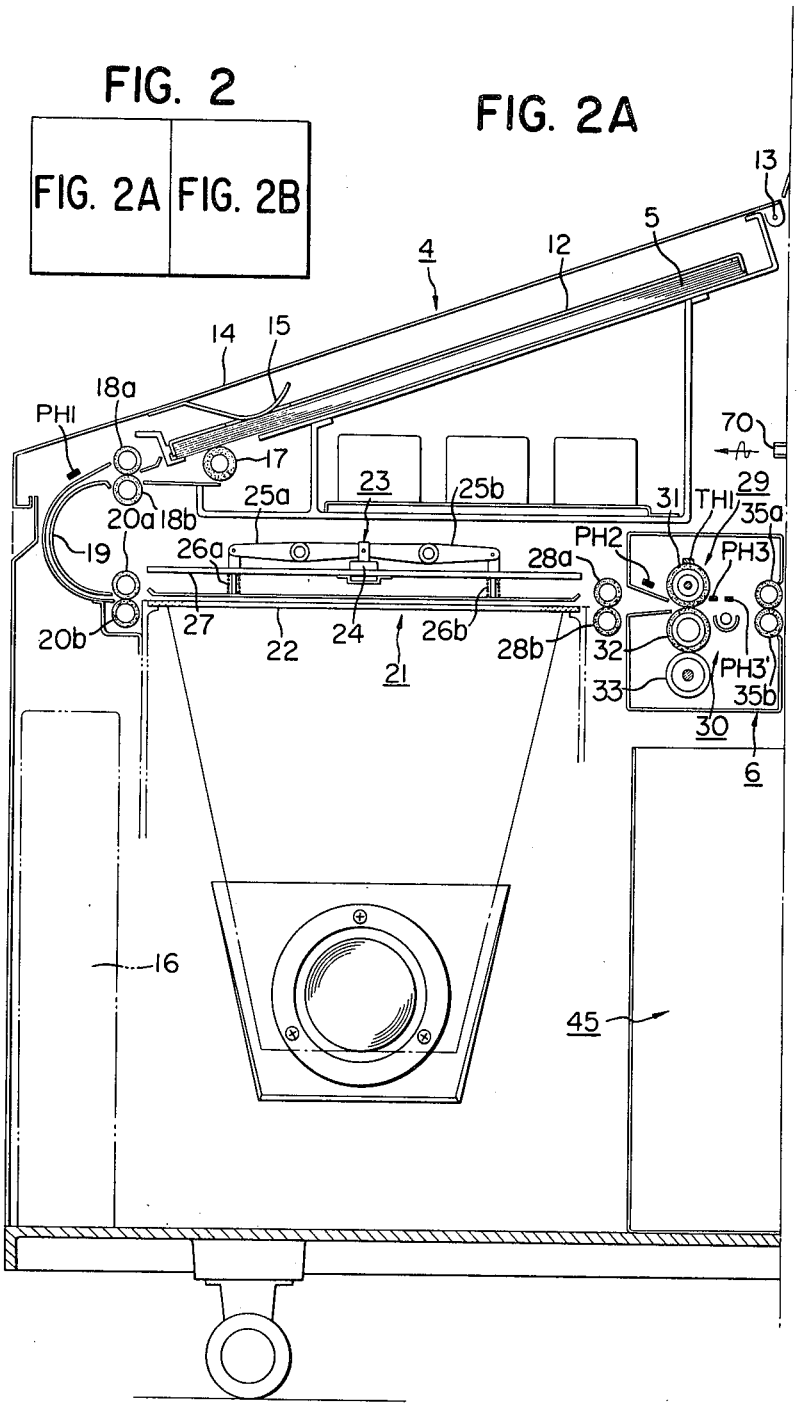
FIG. 2 is a longitudinal cross-sectional view of a first embodiment of the present invention.
Figure 2B:
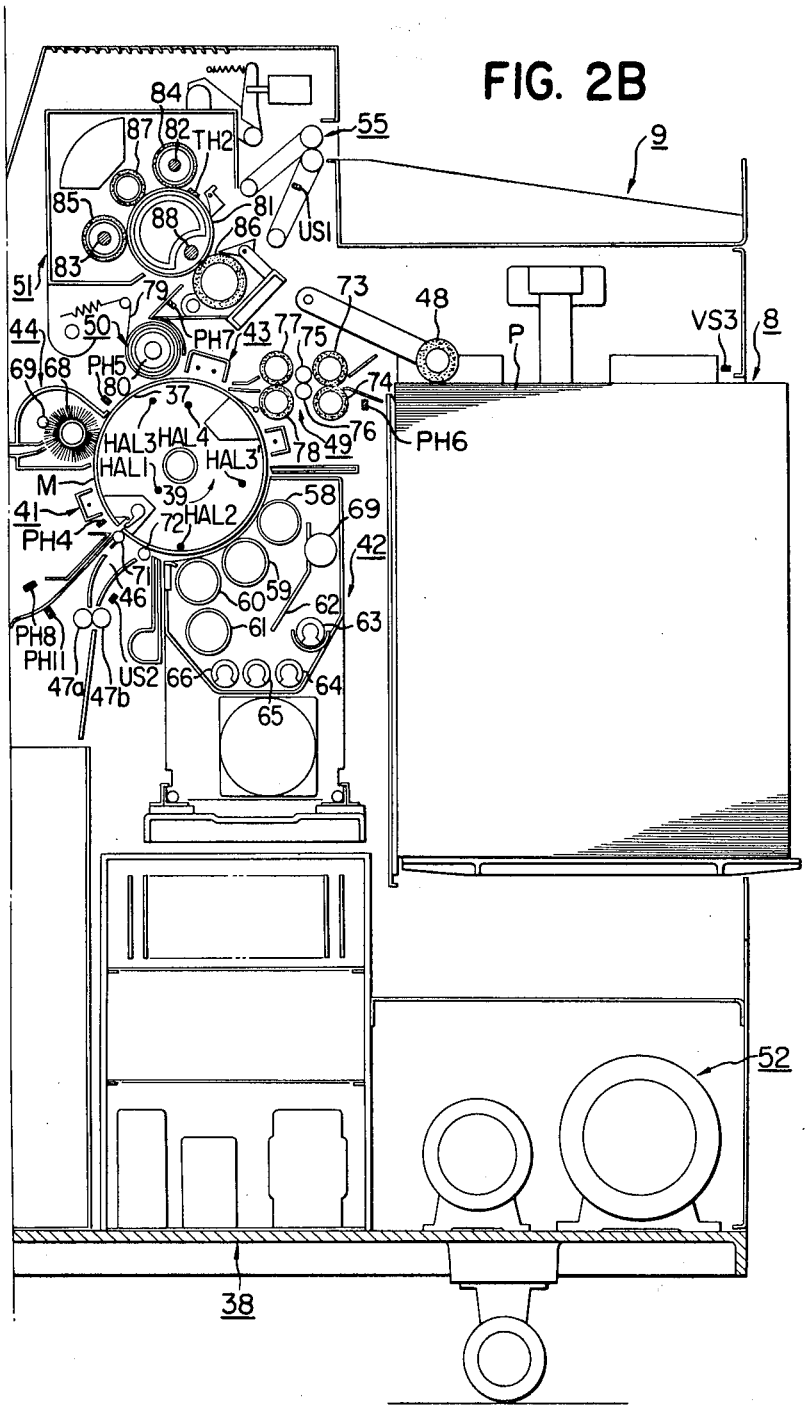

Although the automatic printing apparatus illustrated in FIG. 2 employs the exposure method in standstill state, it will be readily understood that other exposure methods commonly utilized in offset printing or copying fields such as slit exposure, flash exposure, reflective contact exposure, transmission contact exposure or laser scanning exposure, are also applicable for the purpose of the present invention.

Said heat developing unit 6 is provided with a conduction heating means 29 and a radiation heating means 30. Said conduction heating means is for example composed of an upper roller 31, an intermediate roller 32 and a lower roller 33, wherein said upper roller 31 being a metallic roller provided therein with a heating means such as a heater and further provided on the periphery thereof with a releasing layer composed for example of silicon rubber to perform the functions of heating and pressurizing, while said intermediate roller 32 being composed for example of a metallic roller provided on the periphery thereof with a releasing coating composed for example of silicon rubber, and said lower roller 33 being for example a metallic roller provided therein with a heating means such as a heater for heating the surface of said intermediate roller 32. In the vicinity of the surface of said upper roller 31 there is provided a temperature detecting means TH1 for controlling the temperature of heat development and thereby performing the heat development in an appropriate manner.

Said radiation heating means 30 is composed for example of an infrared light source and a reflector, and performs a function to selectively heat by radiation the exposed area of said image forming sheet which is already partially heat developed by means of said conduction heating means 29.

Thus, the exposed image forming sheet, upon passing said heat developing unit 6 illustrated in FIG. 2, is at first heated by said conduction heating means 29 to develop an image partially rendered visible, and successively absorbs the radiation from the succeeding radiation heating means 30 selectively according to the density of said image rendered partially visible thereby accelerating the heat development in the exposed areas by the absorbed heat and substantially improving the contrast between the exposed and unexposed areas.

In this manner the master preparation process is applied on the image forming sheet automatically to obtain a master adapted for use in the following electrostatic printing.

Said master thus prepared is further transported by means of a pair of drive rollers 35*a*, 35*b* toward a rotatably supported printing drum 37.

Before reaching the electrostatic printing station, the master is subjected, on the transport path therefor, to the detection of optical density of image pattern on said master by means of an automatic master adequacy detecting means PH11 in order to determine the optimum condition of the electrostatic printing. The detection signal from said detecting means PH11 is supplied to a printing station control unit 38 which in turn releases, in response to said detection signal, a control signal to control the conditions of certain steps (particularly electrostatic charging and development) in the plural processing units for conducting the electrostatic printing process, thereby prearranging the optimum conditions for the electrostatic printing.

The leading end of the master transported toward said printing drum 37 is inserted into an opening in a master hold-release means and grapsed by a clamp 39 provided in said drum 37. In response to a detection signal indicating that the leading end of master is correctly clamped by said clamp 39, the drum 37 starts to rotate in the direction of arrow of full line, and the master is therefore wound along the periphery of said drum 37.

The master is preferably so sized as that said opening on the drum 37 is covered by the trailing end of the master, and such overlapping arrangement of the leading and trailing ends of master prevents the intrusion of developer into the drum 37 through said opening at the development step in a developing unit 42 and also the direct electrostatic charging on the periphery of said drum 37.

It is also possible, after the master is wound on the printing drum 37, to detect the charge potential of the exposed zone (and of unexposed zone) in a standard area previously determined on the master by means of a potential detecting means PH4 and to control the condition of electrostatic charging and/or development in response to the result of said detection thereby achieving the electrostatic printing in optimum state. In such case it becomes possible to dispense with the detection of master adequacy by means of said detecting means 36. Stated differently, optimum electrostatic printing conditions can be determined either by the signal from said automatic master adequacy detecting means 36 or that from said potential detecting means PH4. Naturally the most precise determination of electrostatic printing conditions can be achieved by utilizing both means in combination.

Upon turning on a main switch on the control panel 11, the master detecting means PH5 provided along the periphery of said printing drum 37 is activated to detect whether a master is present around the periphery of said drum 37. Upon detection by said detecting means PH5 of the absence of a master, an instruction signal for initiating the master preparation process is released in response to said detection signal to start the master preparation.

On the other hand, upon detection by said detecting means PH5 of the presence of a master on the drum 37, this detection signal is indicated by an indicating means provided on said control panel 11.

Upon seeing such indication, the operator decides whether the master already present on the drum 37 should be used or not. If he decides not to use the master on the drum 37, he gives an instruction for master emission by means of a control switch provided on the control panel 11 to activate a sequence control for master separation, according to which the master present on the drum 37 is separated therefrom and stored in a used master storage 45. In response to the receipt of a signal indicating the completion of master separation, the master processing control unit 16 releases a master preparation start signal to the master processing units thereby initiating the master preparation process.

On the other hand, in case the operator decides to use the master already present on the drum 37, he gives an instruction, by means of a control switch provided on the control panel 11, for the execution of electrostatic printing according to a desired program, and in response to said instruction the printing station control unit 38 releases an electrostatic printing control signal to initiate the operations of electrostatic printing.

The electrostatic printing process is executed according to a determined program after a master is mounted around the printing drum 37 and when an instruction signal for electrostatic printing process is released.

The electrostatic printing process is performed by the processing units, including an electrostatic charging unit 41, a developing unit 42, a transfer unit 43 and a cleaning unit 44, arranged along the periphery of said printing drum 37.

Said electrostatic charging unit 41 can be composed for example of a corona discharge means and applies an electrostatic charge on the surface of master mounted around the printing drum 37 thereby forming an electrostatic latent image on said surface.

Said developing unit 42 performs the function of rendering said latent image visible by depositing a powdered material such as toner, and is composed of, in the illustrated embodiment, three developing sleeves 58, 59, 60, a pick-up sleeve 61 provided thereunder, a powder supply screw 63 provided with a powder guide plate 62, and three stirring screws 64, 65, 66. The concentration of powder is detected by a disc-shaped concentration detector 67.

Said transfer unit 43 performs the function of transferring the powder image formed in said developing unit 42 on the master surface to the transfer sheet transported from the transfer sheet stack 8, and is composed of a charging transfer means such as by corona transfer or roller transfer. Such transfer means utilized as the transfer unit 43, being capable also of electrostatically charging the surface of master, may also function as the charging unit, whereby the separate charging unit 41 may be dispensed with. In such case, simultaneously with the transfer of powder image from the master to the transfer sheet in the transfer unit 43, the surface of master is electrostatically charged to form an electrostatic latent image ready to be subjected to the succeeding development.

Said cleaning unit 44 has a function of eliminating the powdered material remaining on the master surface after the transfer step, and can be composed for example of a fur brush 68. Said cleaning may also be composed of other cleaning means such as cloth or a blade. The powdered material picked up by said fur brush 68 is shaken off by a flicker rod 69 and taken away by suction through an outlet 70.

Said cleaning unit 44 can also be dispensed with if desirable, and the cleaning function may be in operation not constantly during the rotation of the drum 37 but intermittently for example once every rotation of the drum 37 or once every thousand rotations of said drum.

Upon completion of the electrostatic printing according to the determined program, and in case no further electrostatic printing is intended on the master mounted around the printing drum 37, said master is separated therefrom and forwarded to the used master storage 45. Said separation is achieved by the slow reverse rotation (in the direction of arrow of broken line) of the printing drum 37 in response to a master ejection signal, whereby the free trailing end of the master is guided into a master outlet 46 by means of a pair of rollers 71, 72 and further advanced toward the used master storage 45 by means of another pair of master eject rollers **47*a*, 47*b*. The separation of master is completed by the releasing of clamp 39 when the trailing end of master is held between the master eject rollers 47*a*, 47*b***.

The transfer sheets are supplied, sheet by sheet according to a time sequence control, from the sheet stack 8 to the transfer unit through a paper feed roller 48 and a registration unit 49. Said registration unit 49 is composed of pick-up rollers 73, 74, timing rollers 75, 76 and synchronizing roller 77, 78 and performs the paper feed in synchronization with the rotation of printing drum 37 thereby enabling transfer of powder image on the master onto a determined position of transfer sheet.

Upon completion of the transfer of powder image in the transfer unit 43, the transfer sheet is separated from the surface of master present on the printing drum 37 in a separating unit 50 and transported to a fixing unit 51 for the succeeding process step. Said separating unit 50 is provided with a separating roller 80 rotatable at a high speed and having thereon a number of suction holes and with a separating belt 79 fixed on both ends thereof, through a spring at one end at least thereof. Said separating roller 80 is connected, at one extremity thereof, through a flexible pipe to a suction blower provided in a suction blower unit 52 in order to effect secured separation of transfer sheet by suction at an appropriate timing.

Said fixing unit 51 comprises a rotatable infrared transmitting roller 81 provided therein with an infrared light source, plural drive rollers 84, 85 for driving said roller 81 and provided therein with heating means 82, 83, a pressure roller 86 provided rotatably for pressing the transfer sheet against said infrared transmitting roller 81, and a releasing material coating roller 87 for forming a layer of releasing material on the periphery of said infrared transmitting roller 81.

The transferred powder image on a transfer sheet, upon reaching the fixing unit 51 and passing between the infrared transmitting roller 81 and the pressure roller 86 of said transfer sheet with said powder image facing said infrared transmitting roller, receives the infrared radiation generated in said infrared transmitting roller 81 and the conduction heat therefrom and is semi-permanently fixed onto the surface of transfer sheet. Said plural drive rollers 84, 85 perform a function to drive said infrared transmitting roller 81 and also a function to heat the surface thereof.

Said drive rollers 84, 85 can be composed, for example, of a metal hollow roller provided therein with a heater and further provided on the periphery thereof with a heat-resistant releasing elastic covering composed for example of silicon rubber.

Said infrared transmitting roller 81 is not provided with a supporting shaft but maintained in the determined position thereof by means of plural drive rollers 84, 85 and a pressure roller 86.

The fixing unit 51 is further provided with a jamming detection means PH7 which detects the jamming or delay of transfer sheet in the fixing unit and which, in such case, releases the pressure roller 86 from the pressurized contact with the infrared transmitting roller 81 and simultaneously turns off the heating means 82, 83 in the drive rollers 84, 85 and the infrared light source 88 in said infrared transmitting roller 81.

The control of fixing temperature is achieved by detecting the surface temperature of said infrared transmitting roller 81 by means of a fixing temperature detecting means TH2 provided in the vicinity of the periphery of said roller and controlling, in response to thus obtained detection signal, the heating temperature of said heating means 82, 83 provided in the drive rollers 84, 85.

Upon completion of the fixing step, the transfer sheet having thereon a fixed image is further transported by a transporting means 55 illustrated at right upper side of the fixing unit 51 to the transfer sheet receiver 9. In the path of said transporting means 55 there is provided a jamming detection means VS1 which interrupts, in case the transfer sheet becomes jammed in the transport path from the fixing unit 51 to the receiver 9, the function of some or all of the processing units for conducting the electrostatic printing process.

In the following there will be explained another embodiment of the present invention utilizing particularly a heat-developable image forming element, with particular reference to FIG. 3 which is a schematic lateral view of said embodiment.

Figure 3:
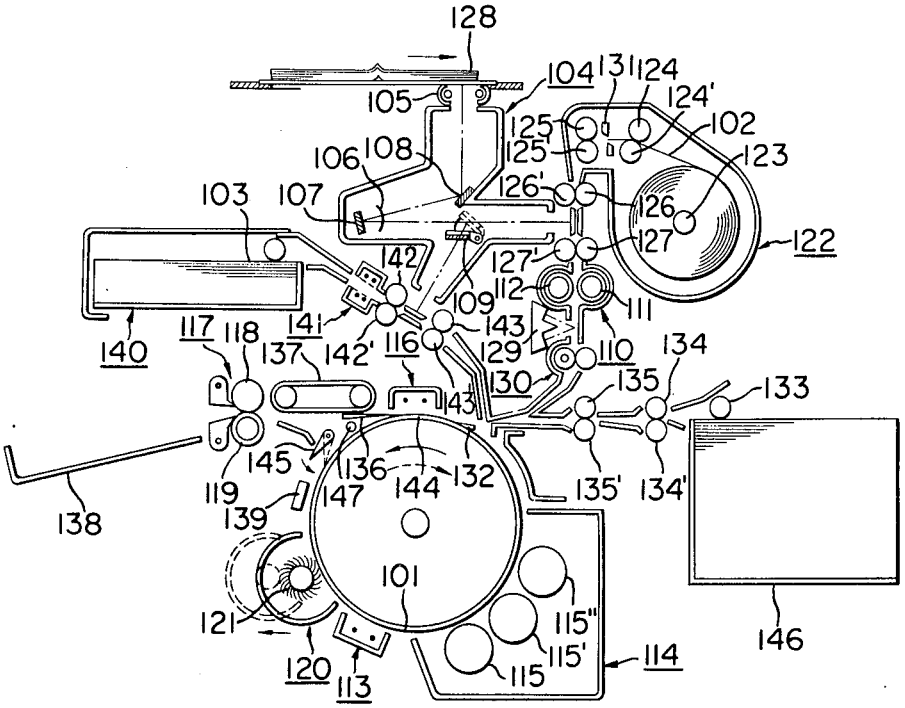
FIG. 3 is a longitudinal cross-sectional view of a second embodiment of the present invention.

Referring to FIG. 3, 101 is a rotatably supported drum around the periphery of which mounted is a master 103 prepared from an image forming element 102. 104 is an optical system for projecting the light image of an original onto the image forming element 102 or the master 103 mounted on the periphery of said drum 101, and can be composed, for example, of a light source 105, a lens 106, and mirrors 107, 108, 109. 110 is a heat developing unit for heat developing the image forming element subjected to imagewise exposure, and can be composed for example of a heat roller 111 and a pressure roller 112 but may also be composed for example of a heater, an infrared lamp or a high frequency heating device.

113 is an electrostatic charging unit for charging the surface of said master mounted on said drum 101 thereby forming an electrostatic latent image on said surface, and can be composed for example of a corona discharge unit.

114 is a developing unit for rendering said electrostatic latent image visible by means of a powdered material such as toner, and is provided, in the illustrated embodiment, with three sleeves 115, 115', 115''.

116 is a transfer unit for transferring the powder image formed on the master surface by said developing unit 114 onto a transfer sheet supplied from a paper feed unit 146, and can be composed for example of an electrostatic transfer unit such as corona transfer device or roller transfer device, a pressure transfer roller unit utilizing a pressure-sensitive adhesive transfer sheet, or further a transfer roller unit utilizing increased pressure which is particularly effective in combination with the liquid development process.

In case an electrostatic transfer is utilized in the transfer unit 116, the electrostatic charging unit 113 may be dispensed with since said transfer unit 116 also has a function of charging unit.

117 is a fixing unit for fixing the powder image transferred onto the transfer sheet, and can be composed for example of a pressure roller 118 and a heat roller 119, wherein said heat roller 119 is most preferably for high-speed fixing composed of a heat radiation transmitting cylinder provided therein with a heat radiation source such as an infrared lamp or a heater. Said heat roller may also be composed of an ordinary conduction heating roller provided therein with a heater.

120 is a cleaning unit for eliminating the powdered material remaining on the master surface after the transfer step, and can be composed for example of a fur brush 121, or other cleaning means composed for example of cloth, brush or plate.

Now in the following there will be given an explanation on the function of the present embodiment of automatic printing apparatus.

A web-shaped image forming element coiled on a spool 123 provided in the image forming element supply unit 122 is extracted therefrom by means of a pair of feed rollers 124, 124' and transported toward the heat developing unit 10 through the guide rollers 125, 125'; 126, 126' and 127, 127' arranged in pairs.

Thus extracted portion of said image forming element 102 is subjected, between the guide rollers 126 and 127, to the exposure of light image of the original 128 to be reproduced by means of the optical system 104. Thus exposed portion of image forming element 102 is further advanced and heat developed, upon passing the heat developing unit 110 to complete the preparation of master.

In the above-mentioned master preparation process, a predetermined portion of said image forming element 102 receives a light exposure of a given amount (hereinafter called standard exposure) before or after or simultaneously with the imagewise exposure, and then (or simultaneously) is subjected to a heat development for a given period in the heat developing unit 110 of a determined temperature. Upon completion of this first heat development, the optical density of said portion subjected to said standard exposure is measured by a density detecting unit 129, and the master is further subjected again to heat development in an auxiliary heat developing unit 130 of which the heat developed density or heat developing speed is controlled according to the measured density, thereby obtaining an optimum master. The control of heat per unit time in response to the measured density of the standard exposed portion after the first heat development may also be applied to the heat developing unit 110, and, in such case, the image forming element 102 which has been subjected to exposure and first heat development has to be moved backwards in the transport path thereof for the purpose of redevelopment. The auxiliary heat developing unit 130 is naturally omitted in such case. The amount of standard exposure is determined according to the species of the image forming element 102.

Said image forming element 102 may be developed, in the first heat development, over the entire surface thereof or only in the standard exposure portion thereof.

Said image forming element 102 is cut into a desired length by means of a cutter 131.

The leading end of thus prepared master is clamped on the outer periphery of the drum 101 by means of a master mounting clamp 132, and the master is intimately pressed against the drum 101 by means of a pressure roller 147 upon rotation of said drum in the direction of arrow in full line and thus mounted on said drum in a tightly wound state along the periphery thereof.

The trailing end of said master is also fixed on the drum 101 by means for example of a suitable clamp. The mounting of master may also be achieved by means of suction.

The electrostatic printing master prepared in the above-mentioned manner is characterized by the smooth surface which is in contrast to the relief pattern in the conventional printing masters. Such smooth-surfaced master, being free from damages resulting from mechanical friction in the course of printing process, assures an improved length of run. Also the unrivaled high resolution of such master, wherein the image is formed by the silver particles, in combination with the above-mentioned smooth surface, provides an extremely high fidelity of the electrostatic latent image in the electrostatic printing process, thus assuring a highly faithful reproduction of the original image.

The master mounted on the drum 101 is at first subjected to the measurement of photographic density of the standard exposure area in said master by means of a printing control unit 139, and the signal obtained by said measurement is supplied to the control devices for the charging unit 113 and developing unit 114 to effect the control of the charging voltage and the developing bias voltage.

Though the charge retentivity of the master is evaluated in the above-mentioned process by measuring the photographic density in the standard density area, it is also possible to evaluate the charge retentivity and to control the charging voltage and developing bias voltage by means of measuring the electric resistance or electrostatic capacity.

For the purpose of obtaining electrostatically printed reproductions of a constant reflective density irrespective of the eventual fluctuations in the charge retentivity of the master, the reflective density in high-light area of said master is measured by the printing control unit 139. For a given processing speed of a master of a known reflective density, the surface potential (fog potential, contrast) attainable on said master is determined as a function of the charging voltage.

In turn, for a given surface potential, the image density can be determined as a function of the developing conditions. In this manner the electrostatically printed reproductions of a constant image density can be obtained irrespective of the fluctuations in the properties of master, by measuring the reflective density of the master and controlling the developing bias voltage and charging voltage according to the result of such measurement.

Either of the density detecting unit 129 and the printing control unit 139 may be dispensed with so long as the other alone is capable of providing satisfactory reproductions.

Once the printing conditions are determined, the master surface is subjected to electrostatic charging by the charging unit 113 consisting for example of a negative corona discharger, thereby causing a negative charge deposition in the surface area where the silver image is absent. Said negative corona discharger may be replaced, if desirable, by a positive corona discharger, an AC corona discharger or a contact charging device.

As the result on the master there is formed a selective distribution of electrostatic charge constituting an electrostatic image or pattern, which is developed in the developing unit 114, by means of conventional developing processes such as cascade development, magnetic brush development, liquid development, magnetic dry development or aqueous development, to obtain a powder image for example a toner image. The toner particles, if not provided with particular electrostatic charge, are deposited on the charged areas of said electrostatic pattern, but, if charged in the same polarity as that of said pattern, will be deposited in the areas where the electrostatic pattern is not present.

Subsequently the toner image is transferred onto a transfer sheet in the transfer unit 116 wherein said transfer sheet is maintained in contact with said toner image and applying for example a corona discharge or a polarity opposite to that of toner particles from behind said transfer sheet by means of a corona transfer device.

The toner image thus transferred is fixed by means of the fixing unit 117, wherein the fixed is achieved by heat fixing, solvent fixing, or simply by drying in case liquid development is utilized, or by pressure fixing.

Subsequently the master surface is cleaned, in order to eliminate remaining toner particles, by the cleaning unit 120 wherein the cleaning is achieved by a cleaning means such as a brush, fur brush, cloth or plate. The cleaning step of master surface is conducted only when necessary and not necessarily indispensable.

The transfer sheets are stored in an ordinary paper feed tray 146 and supplied, when necessary, through a feed roller 133 and drive rollers 34, 34' and 35, 35' arranged in pairs, to the transfer position where the transfer of powder image is conducted.

Upon completion of the transfer of powder image, the transfer sheet is separated from the master surface by a separating device 136 and transported toward the fixing unit 117 by means for example of a suction conveyor belt 137. Upon completion of the powder image in the fixing unit 117, the transfer sheet is temporarily stored in a tray 138. In the illustrated embodiment the structure is simplified and the probability of paper jamming in the transport path is extremely low since said transport path is located above the drum 101 and constructed straight. The illustrated structure is advantageous in that it allows easy removal of eventually jammed transfer sheet due to the presence of transport path above the drum 101, and in that the contamination of entire machine by the developer is prevented due to the developing unit 114 being positioned at the lower part of the apparatus.

The printing process is conducted, after the completion of master preparation process consisting of the exposure and heat development of image forming element, by repeating the steps of electrostatic charging, development, transfer and fixing, or, in case of using the electrostatic transfer for the transfer step, by performing the steps of electrostatic charging, development, transfer and fixing and then repeating the steps of development, transfer and fixing. In this case the cleaning step is occasionally added according to the necessity. Said cleaning step of the master surface is dispensed with in case of the use of so-called electrostatic image transfer step, wherein the electrostatic latent image formed on the master surface is transferred onto an insulating transfer element.

In the use of such electrostatic image transfer step, the printing process is conducted by repeating the steps of electrostatic charging, electrostatic image transfer, development and fixing if a reproduced image is to be directly obtained on said transfer element, or by repeating the steps of electrostatic charging, electrostatic image transfer, development, transfer and fixing if the powder image obtained on said transfer element by developing the transferred electrostatic image is further transferred to an another transfer element such as a transfer paper sheet, and a cleaning step is added in the latter case, if necessary, to eliminate the powder remaining on the transfer element.

The prepared master, when directly transferred to the tray 138 without the succeeding printing process, can be utilized as a direct copy if the optical system 104 is so adjusted in this case as to produce an errect image on the image forming element, which is utilized as a copying sheet in this instance. In this manner, therefore, the printing apparatus of the present invention has a versatile capability covering from a single copying to high-speed multiple copy printing.

Furthermore it is possible to perform copying by supplying, for example, a zinc oxide copying sheet from a separate copy sheet supply unit 140. In such case the copying sheet 103 supplied from said supply unit 140 is uniformly charged by the charging unit 141, and subjected, between two pairs of guide rollers 142, 142' and 143, 143', to imagewise exposure of the image through the optical system 104, thereby forming an electrostatic latent image corresponding to the original image.

The copying sheet holding a latent image thereon is mounted on the drum 101 by a clamp 144 therefore, and is subjected to development in the developing unit 114 upon rotation of the drum 101 in the direction of arrow of broken line. The copying sheet thus developed is released from the drum 101 and transferred to the fixing unit 117 wherein the powder image on the sheet is fixed.

In this case the cleaning unit 120 is displaced to a position of broken line to be away from the surface of drum 101, and the mirror 109 is rotated to the position of broken line at the projection of light image onto the copying sheet.

Although an example of the use of zinc oxide copying sheet has been explained in the present embodiment, it is also possible to utilize other copying sheets such as based on diazonium salt or on free chemistry, and to design the printing apparatus to be adapted to respective copying sheet.

Figure 4:
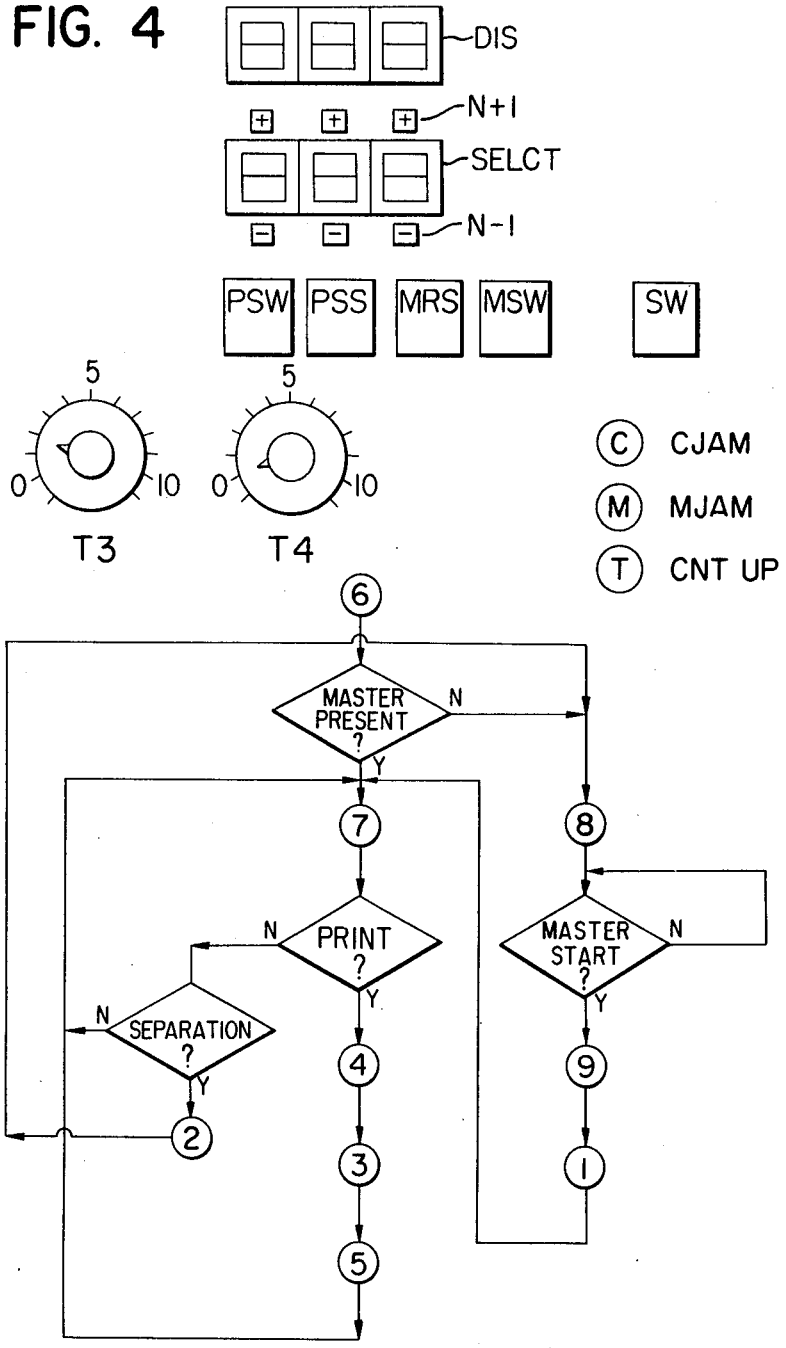
FIG. 4 is a plan view of the control device of the automatic printing apparatus of the present invention.

Now there will be given an explanation on the sequence control employed in the present invention. Referring to FIG. 4 illustrating a control panel of the printing apparatus of the present invention which is represented by the numeral 11 in FIG. 1, there are illustrated a power switch SW, a master preparation switch MSW, a print start switch PSW, a print stop switch PSS, a master reject switch MRS, a jamming detection timer control dial T3, an exposure timer control dial T4, a mechanical number setter of three digits SELCT of which content can be step increased or decreased respectively, a button N+1 or N−1, and a 7-segment display of three digits DIS. Also (1) to (9) are display elements utilizing light-emitting diodes and indicating the progress of process sequence, and CJ, MJ and CT are display elements utilizing light-emitting diodes for indicating respectively the copy paper jamming, image forming element (master) jamming and copy count-up.

The objects of detection and control are listed in the following Tab. 1. Also the objects of detection are shown in FIG. 2.

The photoelectric switch PH2 is provided with a lamp and a light-receiving element and is so constructed as that the interruption of the light of said lamp by an image forming element or a copy sheet can be detected by said light-receiving element. Also the ultrasonic switch US is provided with an ultrasonic oscillator and an ultrasonic microphone to detect the interruption of ultrasonic wave by a copy sheet by means of said microphone. Also the magnetic switch HAL is composed of the Hall elements provided in the positions HAL1–4 on the main frame and a magnet provided so as to pass in the vicinity of said elements by means of the rotation of drum.

Figure 5:
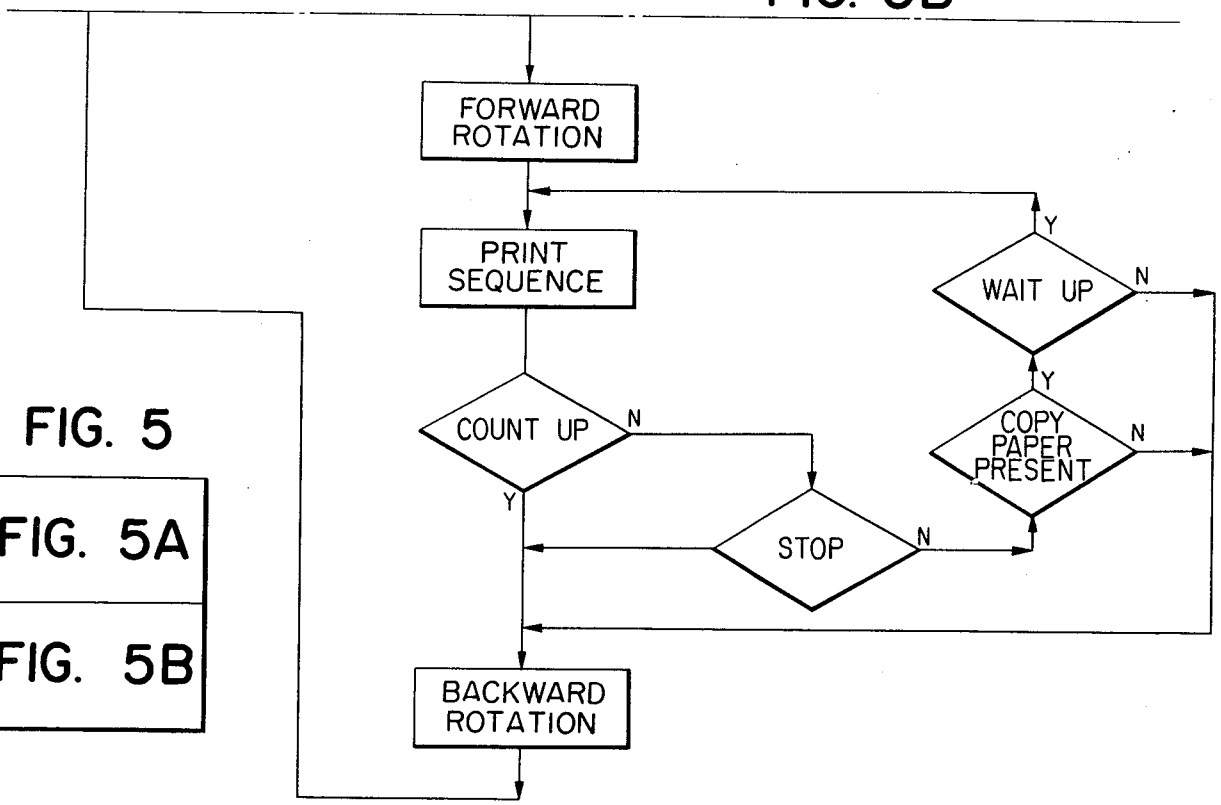
FIG. 5 is a system flow chart of the present invention.
Figure 5A:
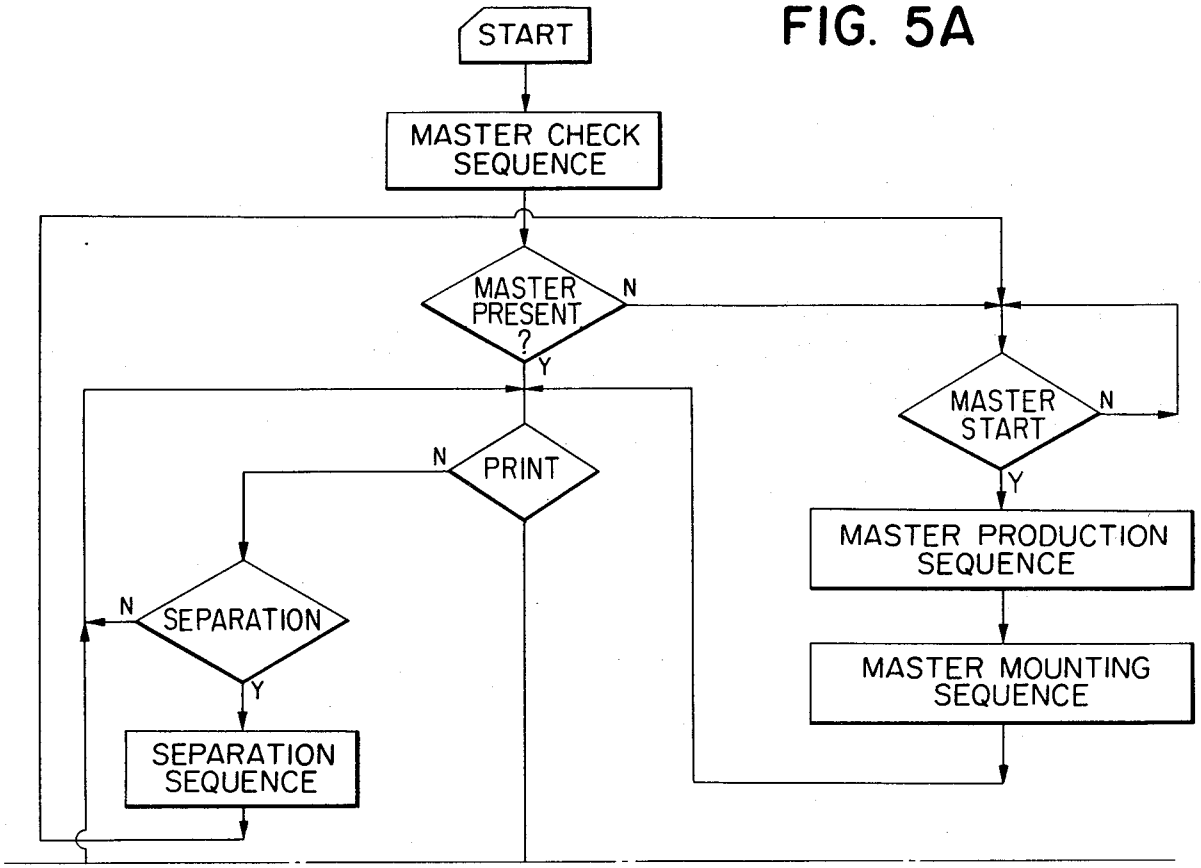

As shown in the system flow chart of FIG. 5, the control sequence is composed of the sequences of master check, master preparation, master mounting, printing and master separation.

The above-mentioned control will be explained in detail in case of a circuit similar to the computer system MCS-4 utilizing a 4-bit parallel CPU 4040 (Intel). PROM is a programmable read-only memory for storing the control sequence (flow) shown in FIGS. *9a–9f* from the address 0 according to the code (instruction, data). RAM is a random access memory for temporarily storing the data at the execution of the above-mentioned flow, wherein the input terminals #0–9 are input ports each of which is utilized for the input of the information necessary for the control and is composed of a gate circuit accepting the input data under an "AND" condition with the port select signal, wherein the four bits in each port are respectively connected with the above-mentioned objects of detection. The terminals #0–9 are output ports for controlling the objects of control (loads) and consisting of latch circuits to be activated by a port select signal, and 4 bits in each port are respectively connected to said objects of control through amplifiers.

Figures 8, 8A, 8B:
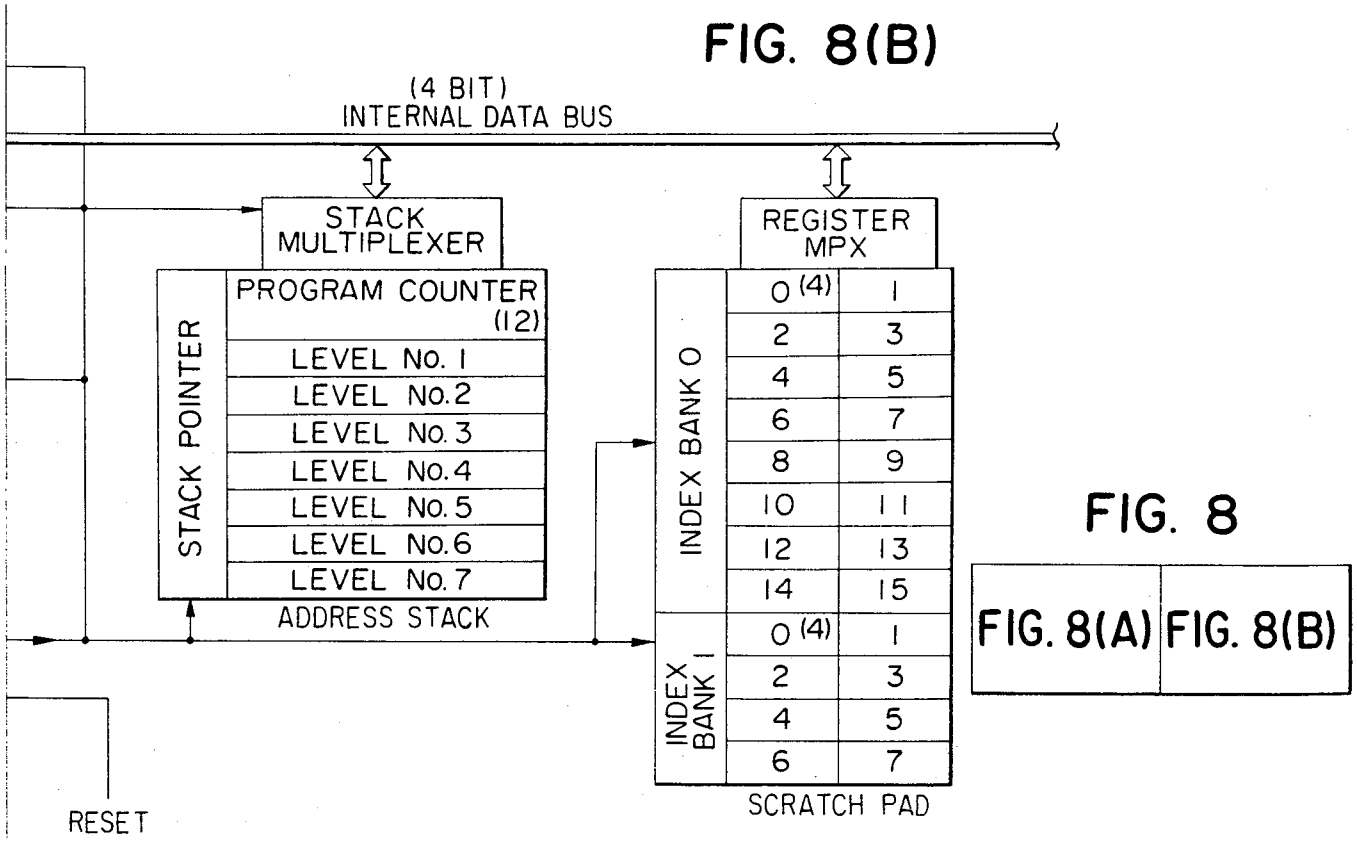
FIG. 8 is an illustration of a circuit inside the CPU in FIG. 6.
Figure 8A:
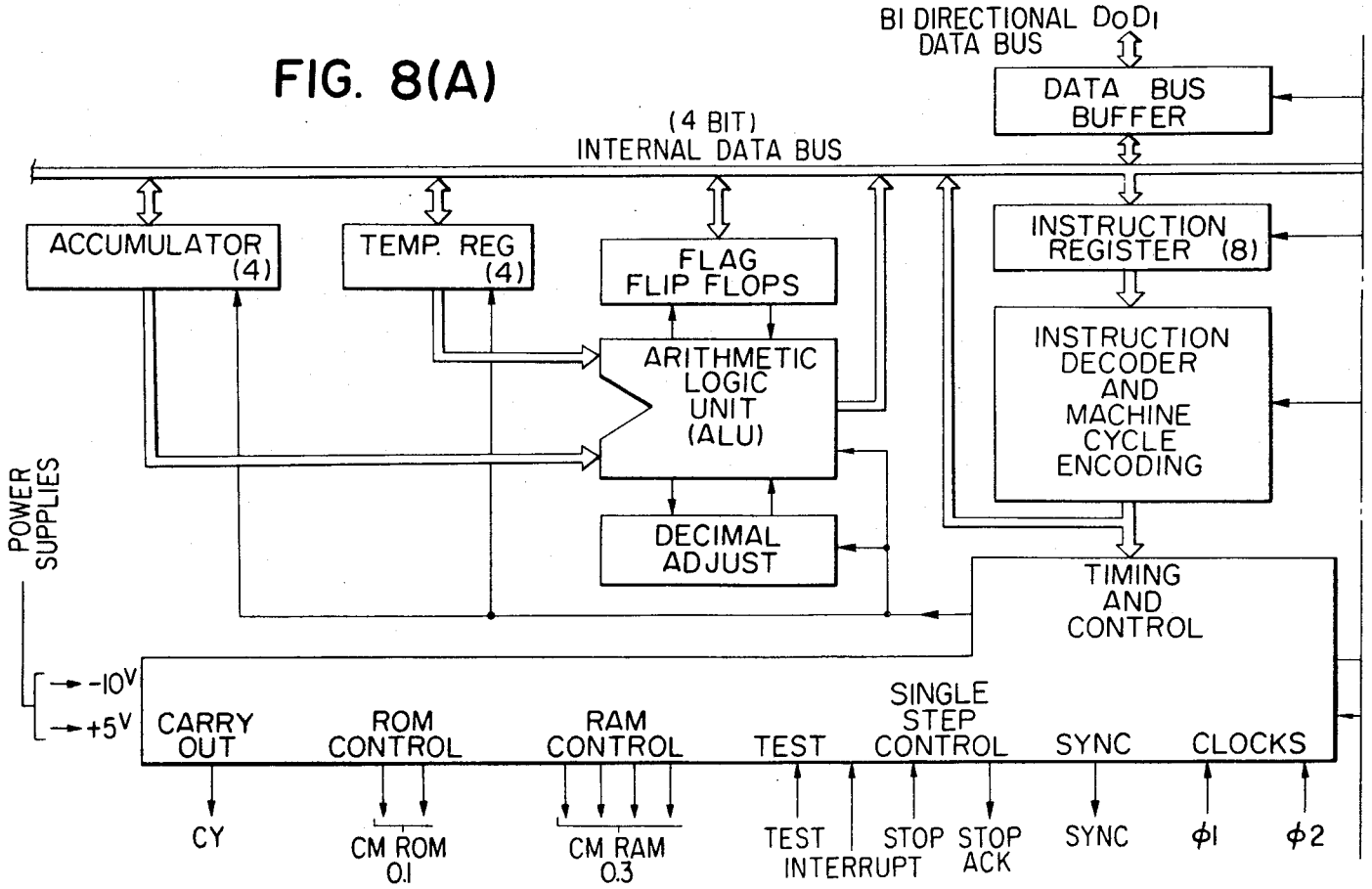

CPU is a processor which detailedly explained in the manual MCS-4 (FIG. 8). A memory interface is provided for the selection of input/output port and for addressing of the PROM. Also there is provided a decoder as a converter from 4 bits to 16 bits for selecting the input-output ports #0–9, and a buffer for temporary storage of data from the input ports or to the output ports.

As already known, the CPU performs the function, upon receipt of clock pulses $\phi$, of counting said clock pulses by a program counter (FIG. 8), releasing an address data for designating the address 0 of ROM from D0–D3 at a determined number of clocks, receiving the instruction stored at the address 0 of ROM through an interface, decoding said instruction by means of an instruction decoder, thus providing an output data or an address data to the accumulator ACC or to the register IR or giving the output of IR address data sequentially from D0–D3 thereby designating and selecting the input/output port by the upper 4 bits or performing the output or input of output/input data through thus selected port.

TABLE 1

| | |
|---|---|
| Clutch | |
| CL1 | Image forming element pick-up |
| CL2 | Image forming element transport |
| CL3 | Drum rotation |
| CL4 | Printing drum rotation |
| CL5 | Copy sheet pick up |
| Solenoid | |
| SOL1 | Shutter drive |
| SOL2 | Exposure registration |
| SOL3 | Pressurizer activate |
| SOL4 | Drum fix at home position |
| SOL5 | Gripper drive |
| Motor | |
| M1 | Master transport (forward/reverse) |
| M2 | Drum drive |
| M3 | Master mount/release drive |
| M4 | Developer drive |
| M5 | Elevator drive |
| Relay | |
| K1 | Drum forward rotation |
| K2 | Drum reverse rotation |
| Photoelectric switch | |
| PH1 | Master insert detection |
| PH2 | Master exposure position detection |
| PH3 | Master developing density detection |
| PH4 | Master multiple forwarding detection |
| PH5 | Master mounting detection |
| PH6 | Paper feed detection |
| PH7 | Transfer detection |
| PH8 | Master grip detection |
| Ultrasonic switch | |
| US1 | Paper eject detection |
| US2 | Master eject detection |
| US3 | Copy paper stack height detection |
| Magnetic switch | |
| HAL1 | Master grip position detection |
| HAL2 | Drum print position detection |
| HAL3, HAL3' | Paper feed position detection |
| HAL4 | Jamming position detection |

In the present example the electronic components employed are 4002 for RAM, 4289 for interface, 1702A for PROM, 3205 for decoder, DM8093 for buffer, 8234 for gate and 3404 for latch.

Figure 7A:
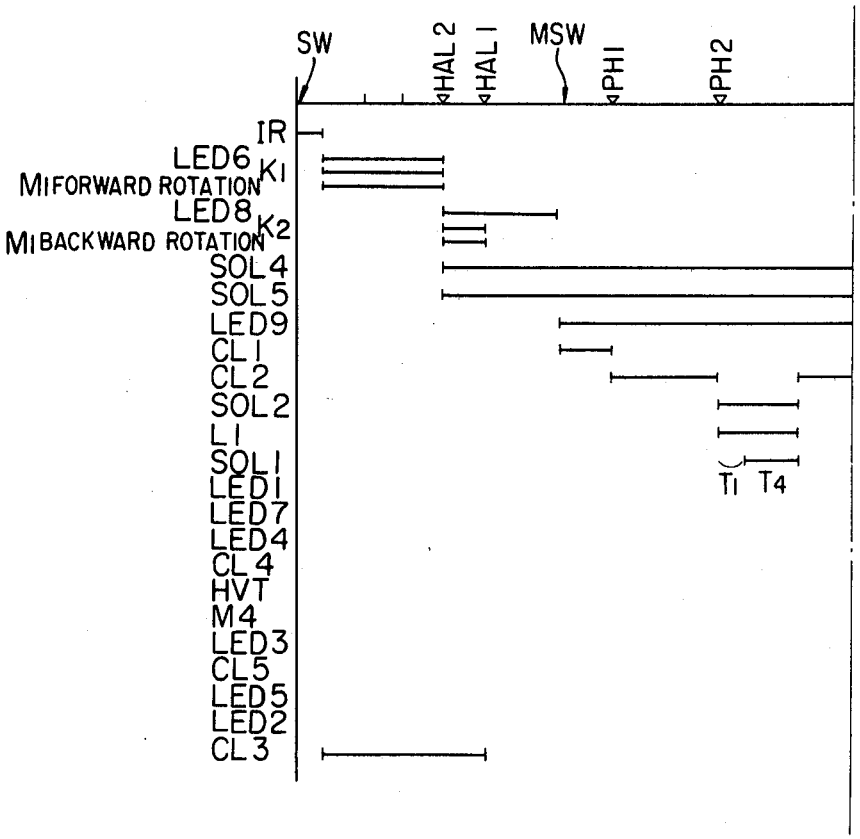
FIG. 7 is a time chart of the functions of the apparatus of the present invention.
Figure 7:
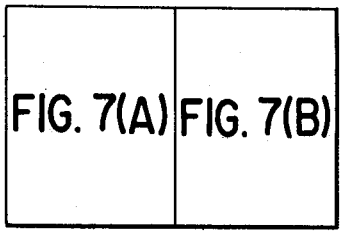
Figure 7B:
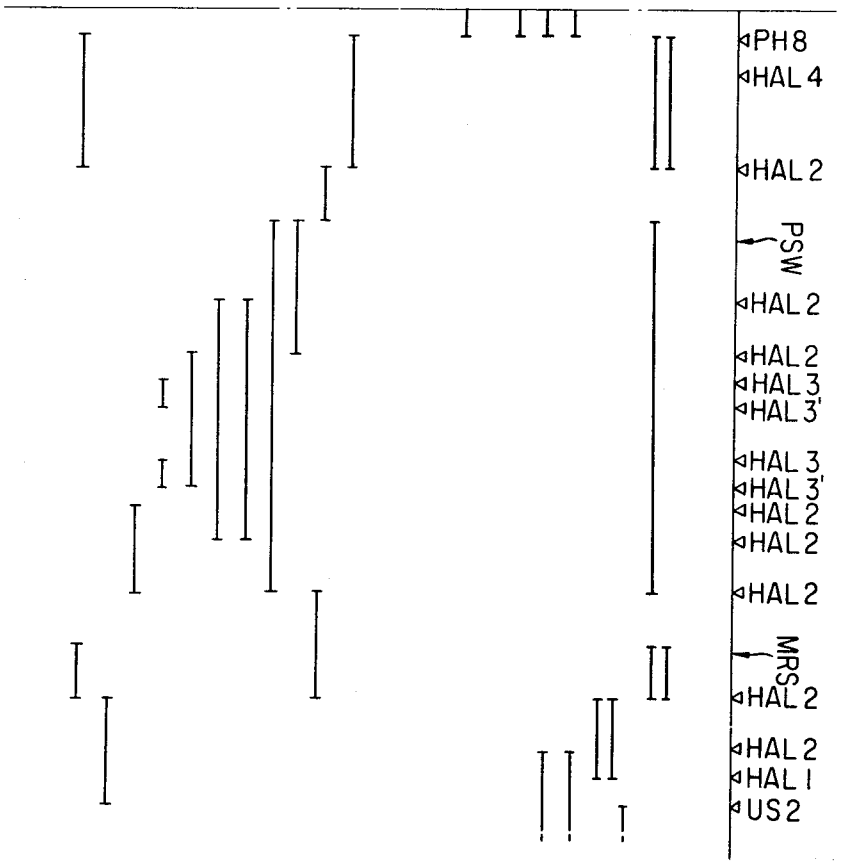

Now the control sequence will be explained in detail, in the following, while referring to a time chart in FIG. 7, a flow chart in FIG. 9 and circuits shown in FIG. 6.

At first, the turning on of the main switch SW puts the drum motor M2, heat developing heaters H1, H2, and fixing heaters H4, H5, H6 into operation, and starts the generation of clock pulses for driving the CPU.

Resetting

The CPU reads the address 0 of ROM, decodes the instruction code, selects the output ports #0–9 in succession and releases an output data (0000) thereby resetting the output ports #0–9.

After a time T1, the input port #5 is read to check whether the initial reset signal (IR) has shifted from H to L level, as will be explained further in the following. Said IR signal is maintained at H-level until the transient phenomenon at the turning on of the power becomes stabilized, and is obtained from a charging signal of an external condenser.

Master Check

Upon identifying the L-level of the resetting signal IR, there is initiated a check routine for detecting whether a master is mounted on the drum.

At first an indicator LED6 is lighted to indicate the check routine, and the relay K1 is activated to start the drum motor M1 thereby causing the forward rotation (arrow in FIG. 2) of the drum. Upon three rotations of the drum and detection three times of the print position HAL2, the relay K1 is deactivated at arrest the motor M1 and to extinguish the LED6. Then the input port for the master detector PH5 is read to identify whether the PH5 is at H-level. The master, being provided with black check zone for this purpose, can be identified from the white drum surface.

If the presence of a master is identified, the control turns on the LED7 and shifts to a sequence for identifying whether the print button or reject button is actuated (a jump to the step A001 in the flow).

If the absence of a master is identified, there is lighted the LED8 and the relay K2 is activated to cause the reverse rotation of motor M1 thereby causing the drum to displace from the print position HAL2 to the grip position HAL1. Simultaneously further activated are the solenoid SOL4 for opening the grip and the solenoid SOL5 for advancing a pin to fix the drum. Now the control proceeds to a routine to identify whether the gripper arrives at the grip position HAL1. Upon rotation of the drum to the grip position, a pin is inserted into the already opened gripper to fix the drum, simultaneously the relay K2 is deactivated, and the clutch CL3 connecting the motor M1 and the drum is controlled by the relay signal. Successively there is initiated a routine for identifying whether the heat developer has reached a determined temperature, and a routine for reading the input port #3 connected to the switch MSW is initiated by the input signal (DUP=H) to the input port #8 upon detection of said temperature. (Master preparation sequence)

Upon detection of the input signal to the input port #3 indicating the turning on of master switch MSW, the LED8 is extinguished while the LED9 is lighted to indicate the master preparation sequence. Then the clutch CL1 is activated to drive the pick-up roller 17 thereby initiating the advancement of the image forming element.

After a time T2, the input port #4 is read to identify whether the image forming element has reached the detector PH1. The master should be present at PH1 after time T2 in normal feed. In case of failure of detection, therefore, the control proceeds to the master jamming sequence (a jump to the step MJAM in the flow).

An H signal from the detector PH1 disconnects the clutch CL1 and connects the clutch CL2 to drive the feed rollers 18, 20, 28 thereby advancing the master to the exposure position. Simultaneously an external timer T3 is started by the output port #9, and the arrival of the master to the exposure position is identified by addressing the input port #6 and reading the master detector PH2 connected to the 4th bit of said input port. In case the PH2 is at L-level, the input port #8 is read to identify if the time of the timer T3 has already elapsed, and a shift to the MJAM routine if the time has already elapsed. Upon generation of a signal indicating that the master has arrived PH2 (PH2=H) before the lapse of said time, the clutch CL2 is disconnected to stop said feed rollers, and solenoid SOL2 is activated to actuate the pressure plate 27 thereby placing the image forming element in the exposure position. Successively the lamp L1 is lighted, and, after a time T1, the solenoid SOL1 is activated to open the shutter thereby initiating the projection of original image onto the image forming element. Simultaneously the external timer T4 is started, and the exposure is terminated after a time T4 by deactivating the solenoid SOL 1. Said timer T4 is arbitrarily selected in advance on the control panel. Successively the lamp L1 and the solenoid SOL2 are turned off, and the clutch CL2 is activated at the same time to forward the image forming element into the heat developer.

Upon arrival of the master to the master detector PH3, another detector PH3' identifies whether the master has been sufficiently heat developed. In case of an insufficient development, the PH3' gives an H-level signal since a check zone provided in the leading end of the master is gray and is therefore provided with an elevated reflection. Upon detection of said H-level signal, an infrared heater is lighted to supplement the development.

Upon advancement of the master to the grip position, there is formed a loop in the vicinity of the detector PH8, which should be arranged so as to detect said loop. The input port #7 is continuously read after the heat development, and, upon detection of an H-level signal by the detector PH8, the clutch CL2 is disconnected to terminate the advancement of master.

Master mounting sequence

Upon detection of the arrival of master at the grip position, the LED9 is turned off and the LED7 is lighted. Simultaneously the solenoids SOL4, 5 are deactivated to close the gripper by a spring action thereby holding the master. Simultaneously the drum is rendered rotatable since the pin is extracted.

Successively the relay K1 is activated to cause forward rotation of the motor M1 and the drum, thereby winding the master along the periphery thereof. Upon one full rotation from the grip position and an additional rotation to the print position, the drum is stopped by the H-level signal of HAL2.

In this position the input port corresponding to the master detector PH5 is read to identify the presence or absence of master on the drum. An L-level signal of PH5, signifying that the master has dropped, causes a shift to the MJAM routine. Also an H-level signal of PH5 causes the control to proceed to the preparation for the printing.

Print sequence

The input ports #0–2 are read to memorize the number of prints in three digits in the RAM. Said number is simultaneously displayed through output ports #0–2. Successively the output WVP from the temperature detector of fixing unit is read to identify whether it is at H-level, signifying the determined temperature. If it is H-level, the presence of copy sheets is confirmed by a detector US3 (CPO=H), and then it is identified whether the print switch is turned on (if so H-level). In case WVP or CPO is L-level, the print operation is not initiated even when the print switch PSW is actuated. Also even when these conditions are satisfied, the master separating sequence (step A002) can be initiated by actuating the master rejection switch MS. If neither of PSW or MRS is actuated, there are again conducted the read-in of copy number setting, temperature check and copy paper check.

Upon actuation of PSW (H-level), the LED7 is turned off and the LED4 is lighted to indicate that the forward rotation mode is initiated. Then the clutch CL4 is connected to shift the drum from the motor M1 to the high-speed motor M2.

Upon detection of the arrival of drum to the print position HAL2 after a full turn, the high voltage source HVT connected to the chargers and the developing motor M4 for agitating toner are turned on. Upon a further full turn of the drum, the LED4 is turned off and the LED3 is lighted to indicate that the print mode is initiated.

Successively the display DIS is caused to indicate zero in order to count the copy number. This is achieved by storing "0" in the index register IR4–6 in the CPU and releasing this information through the output ports #0–2.

Upon detection of the paper feed position by HAL3 on the drum, there is activated the paper feed clutch CL5 to descend the constantly driven feed roller 48 thereby feeding the copy sheets to the drum.

Upon detection of the drum position HAL3' (detection of magnet 3' by the Hall element 3), the CL5 is disconnected. In this state the copy sheet is advanced by the registration rollers 73, 74, to reach the paper detector PH6. Thus, a L-level signal of PH6 causes a shift to the copy sheet jamming routine CJAM. On the other hand, if the PH5 is at H-level, the PH5 identifies whether the master has dropped from the drum, and, if L-level, the master jamming routine MJAM is initiated.

If the master is in normal condition, the register IR4–6 is step advanced to record that one copy sheet is transported, and the content of said register is released through the output ports #0–2 to indicate "001". Also the dial setting supplied to the input ports #0–2 are read into the CPU accumulator ACC and compared with the content of the register IR0–2 for coincidence.

In case of coincidence, the paper feed is terminated and the sequence proceeds to the termination mode. In case of no coincidence, an identification is made as to whether the stop button PSS is actuated, and the sequence proceeds to the termination mode if the PSS is at H-level, or if copy sheet is absent on the copy sheet tray (CPO=L) or if fixing temperature is low (WVP=L) even when the PSS is at L-level. Also the routine for reading the paper feed timing (checking HAL3) is restarted if the copy number is still deficient and the above conditions are satisfied.

The stop button PSS, once actuated, holds its state.

Print termination sequence

Now the LED3 is turned off and the LED5 is lighted to indicate the termination mode. The drum is made to rotate a full turn, and the high-voltage transformer HVT and developing motor M4 are switched off at the print position HAL2. The drum is made further to rotate a full turn, and the clutch CL4 is disconnected at the same position to arrest the drum.

Successively the LED5 is turned off and the LED7 is lighted to indicate the stand-by state for printing, thus the sequence proceeding to aforementioned print mode (step A001).

Separation sequence

Upon actuation of separation button (MRS=H) in the print mode, the sequence proceeds to the step A002 in the separation routine.

The relay K1 is activated to start the motor M1 thereby initiating the rotation of drum, and, upon detection of the print position HAL2, the relay K1 is deactivated to arrest the drum while the relay K2 is activated to initiate the reverse rotation of drum. Now the LED7 is turned off while the LED2 is lighted to indicate the separation mode. Upon arrival of the drum to the print position HAL2 after one reverse turn, the solenoids SOL4, 5 are activated to open the gripper and actuate the pin. Said reverse rotation causes the trailing end of master to be inserted into the outlet, thereby initiating the separation of master. Upon arrival of the drum to the drum grip position HAL1, the pin is inserted into the drum while the gripper is opened to cause the master to be removed from the drum by means of eject rollers.

Upon detection of said position HAL1, the relay K2 is deactivated to terminate the rotation of drum, and the detector PH5 identifies whether the master is still present on the drum. If PH5 is at H-level, the sequence proceeds to the master jamming routine MJAM.

Also the master detector US2 provided at the master outlet identifies the separation of master, and, if US2 is at L-level, the sequence similarly proceeds to the routine MJAM.

Upon detection of normal ejection of master, the LED2 is turned off and the LED8 is lighted, and the sequence proceeds to the step A002 of master preparation routine to prepare for the succeeding master preparation.

Copy sheet transport

The copy sheet, after feeding step, is transported to the transfer unit with a timing controlled by a register mechanically linked with the drum.

Figure 10:
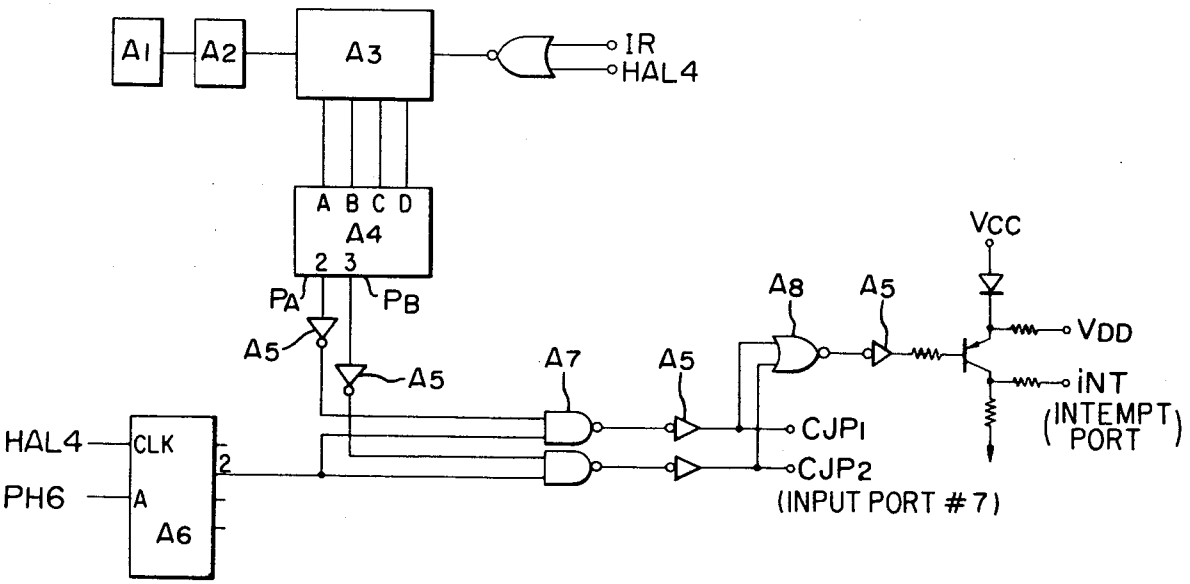
FIG. 10 is an illustration of a jamming detection circuit.
Figure 11:
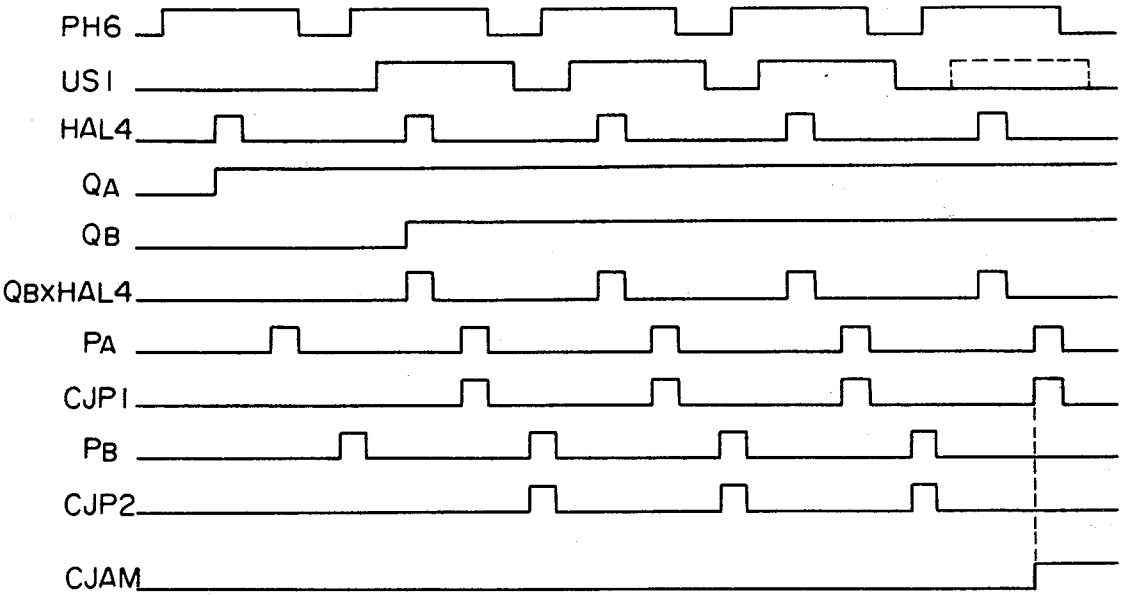
FIG. 11 is a time chart of the circuit shown in FIG. 10.

The eventual jamming of the copy sheet is identified by check pulses CJP1, CJP2. FIG. 10 shows a circuit for generating said check pulses and supplying said pulses to the CPU input terminal INT and to the input port #7. Upon release of CJP1, the H-level at the terminal INT causes the content of accumulator ACC and of the carry flag FF to be saved in the RAM, and the effective address of the program counter to be saved in the stack pointer. The jamming is identified by reading the ROM address into a routine for identifying whether the terminal CJP1 of input port #7 is at H-level and a routine for identifying whether the ejection detector US1 has identified the copy sheet. The sequence proceeds to the CJAM routine if the US1 is at L-level. Also if US1 is at H-level at the interrupt input by H-level CJP2, the copy sheet is considered to be stopping on the detector, and the sequence proceeds to the CJAM routine. Upon identification or normal paper feed and upon receipt of instruction to return to main program, the saved address an content of ACC are recovered to execute the main program. In FIG. 10 there are illustrated an oscillator A1, a frequency divider A2, a counter A3, a decoder A4, an inverter A5, a shift register A6, a "NAND" gate A7 and a "NOR" gate A8, while FIG. 11 shows a time chart of the circuit of FIG. 10. In this circuit the check pulses CJP1, CJP2 are generated upon second detection of HAL4, and the divider A2 is so constructed as to generate 16 pulses corresponding to a displacement of the copy sheet length.

MJAM step

The output ports #3–9 are addressed and all the bits thereof are cleared by zero signal. Also lighted is an LED indicating MJAM, and the entire apparatus is maintained in halt state.

CJAM step

The output ports #3–9 are cleared in a similar manner as in the MJAM step, and CJAM LED is lighted. Also the output port #4 is addressed to activate the SOL3 thereby releasing the pressure of fixing roller and realizing the halt state. The halt state is cancelled by turning off the power switch SW.

The program codes for the above-mentioned control can be obtained from the manual for MCS-4 and from the flow chart of FIG. 9.

Now the reset sequence and the master check sequence will be explained according to the program code list.

At the step B001, upon reading of LDMO by CPU and decoding thereof by the decoder (ID), signal (0000) is set in the accumulator ACC. Successively upon decoding of FIM 0,0, signals 0000,0000 are set in the 0,1 pair of the index register (IR) of scratch pad memory. Upon reading SRCD there is addressed the port #0 for IR0 content, and upon reading WRR the content (0000) of the accumulator AC is supplied to the output port #0. Upon reading ISZ the IR0 is step increased to 0001, and upon reading again of SRC the port #1 is addressed. Successively WRR causes the content (0000) of the accumulator ACC to be supplied to the output port #1. The resetting of output port #0–9 is achieved by repeating this routine until IR0 reaches zero (by 16 step increases).

The reading and decoding of JMS T1 causes the storage of step address into the uppermost portion of stack pointer (SP) and the sequence to proceed to the subroutine of timer T1. Upon completion of the subroutine, the SP is step increased and the sequence returns to the routine B004. Similarly reading of FIM 0,5 causes the setting of 5,0 into the IR, and, upon reading SRCD, the input port #5 is addressed. Then the reading of RDR causes the data of #5 (WVP, PSS, PSW, IRS) to be stored in the accumulator ACC. Upon reading of RAR, the content of said accumulator ACC is rotated to the right by one bit. Stated differently the content of carry (CY) is set in the flag flip-flop through the calculator ALU. Since the initial reset signal corresponds to the fourth bit, the input of reset signal generates a signal "1" in the flip-flop by the rotation to the right. Upon reading of JC, it is identified whether said flip-flop contains a signal "1". In case FF=0 (CY=0), the sequence proceeds to the next step since the reset signal is cancelled, while the step from FIM 0,5 is repeated if FF=1.

Successively LDM2 causes the storage of (0010) into ACC, FIM 0,7 causes the storage of 7,0 into the IR, and WRR causes the output of ACC content, output of 1 on two bits of output port #7 and turn of the check mode indicator LED6.

Successively FIMX'E', 'DQ' cause the storage of D (=14) into the address 'E' of the register IR. Then the relay K1 is activated to cause forward rotation of the motor M1, and the sequence proceeds to a subroutine PROS for detecting the print position HAL2, and causes leftward rotation twice. The instruction JNC identifies the "1" in the second bit, and, upon detection thereof, the instruction ISZ step advances the content of the address "E", and the PROS routine is repeated until said content reaches 17. Thereupon the sequence proceeds to B006, namely a step of rotating the drum three turns and turning off the relay K1 and LED6.

The sequence then proceeds to a subroutine of reading PH5, and, upon similar rotation of the content of accumulator and upon detection of carry by the instruction JC, the sequence turns on the LED7 and proceeds to the print routine A001.

Upon identifying non-carry, i.e. the absence of master on the drum, the sequence proceeds to a step of turning on the LED8 and relay K2 thereby causing reverse rotation of drum.

Further the instruction LDMX'C' causes the storage of (0011) into the AC, and the FIM p,4 causes the output of ACC content to the output port #4 and activates the solenoids SOL4, 5 to prepare for the master mounting. The sequence proceeds, after executing the subroutine for detecting the grip position HAL1, to the succeeding master preparation routine A003.

Tab. 2 shows the subroutines T1, and POS. Also Tabs. 4 and 5 show the code lists for the drum mounting and master separation. Other flows are omitted since they can be obtained by modifying the above-mentioned programs.

Figure 12:
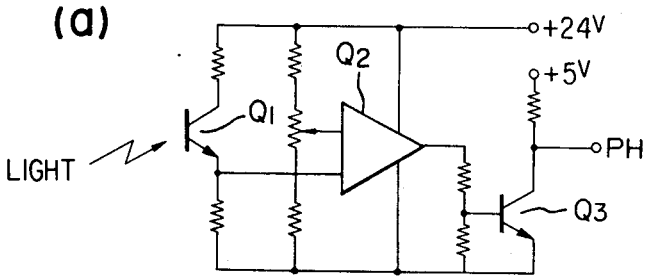
FIG. 12 is an illustration of an example of the detection circuit.
Figure 12:
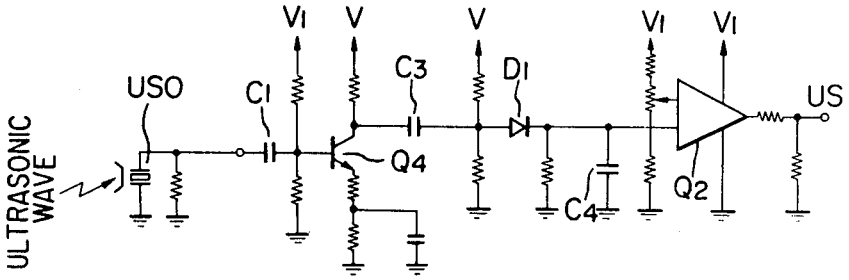
Figure 12:
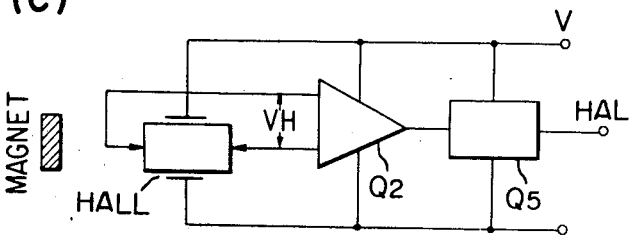

FIG. 12 shows an example of detector circuit, wherein (a), (b) and (c) are respectively for obtaining PH, VS and HAL signals. In these figures Q1 is a phototransistor, Q2 an operational amplifier, Q3 a voltage converting transistor, US0 an ultrasonic oscillator, Q4 an AC amplifier, D1 and C4 rectifiers, HALL a hall element, and Q5 a Schmidt trigger circuit.

TABLE 2

| | | | |
|---|---|---|---|
| | START | | |
| | NOP | | |
| | JUN | B001 | |
| | JUN | B002 | |
| B001 | LDM | 0 | |
| | FIM | 0, 0 | |
| B003 | SRC | 0 | |
| | WRR | | All output port reset |
| | iSZ | 0, B003 | |
| | JMS | $T_1$ | Timer $T_1$ sub |
| B004 | FIM | 0, 5 | |
| | SRC | 0 | |
| | RDR | | |
| | RAR | | |
| | JC | B004 | |
| | LDM | 2 | IR = 0 ? |
| | FIM | 0, 7 | |
| | SRC | 0 | |

TABLE 2-continued

| | | | |
|---|---|---|---|
| | WRR | | LED6 on |
| | FiM | X'E', X'Do' | |
| | LDM | 1 | |
| | FIM | 0, 3 | |
| | SRC | 0 | |
| | WRR | | $K_1$ on |
| B005 | JMS | POS | Print position sub |
| | XCH | X'F' | |
| | RAL | | |
| | RAL | | |
| | JNC | B005 | Print position H ? |
| | iSZ | X'E', B006 | |
| B007 | JMS | POS | |
| | XCH | X'F' | |
| | JNC | B005 | |
| | JUN | B007 | |
| B006 | LDM | 0 | |
| | FiM | 0, 3 | |
| | SRC | 0 | |
| | WRR | | $K_1$ off |
| | LDM | 0 | |
| | FiM | 0, 7 | |
| | SRC | 0 | |
| | WRR | | LED6 off |
| | JMS | PH5 | |
| | JNC | B008 | PH5 H ? |
| | LDM | 4 | |
| | FiM | 0, 8 | |
| | SRC | 0 | |
| | WRR | | LED7 on |
| | JUN | A001 | Print |
| B008 | LDM | 8 | |
| | FiM | 0, 8 | |
| | SRC | 0 | |
| | WRR | | LED8 on |
| | LDM | 2 | |
| | FiM | 0, 3 | |
| | SRC | 0 | |
| | WRR | | $K_2$ on |
| | LDM | X'C' | |
| | FiM | 0, 4 | |
| | SRC | 0 | |
| | WRR | | |
| B009 | JMS | POS | Grip position sub |
| | XCH | X'F' | |
| | RAR | | |
| | RAR | | |
| | JNC | B009 | |
| | JUN | A002 | Master preparation |

TABLE 3

| | | | |
|---|---|---|---|
| | T1 | LDM | 4 |
| | | XCH | 3 |
| | | FIM | 0, 0 |
| | | LDM | 0 |
| | | XCH | 2 |
| | T01 | ISZ | 0, T01 |
| | | ISZ | 1, T01 |
| | | ISZ | 2, T01 |
| | | ISZ | 3, T01 |
| | | BBL | 0 |
| | PoS | LDM | 3 |
| | | XCH | X'C' |
| | | SRC | X'C' + 1 |
| | | RDR | |
| | | XCH | X'F' |
| | | BBL | 0 |

TABLE 4

| | | | |
|---|---|---|---|
| C001 | JMS | PH8 | |
| | RAR | | |
| | JNC | C001 | |
| | LDM | 4 | |
| | FiM | 0, X'40' | |
| | SRC | 0 | |
| | WRR | | Gripper off |
| | LDM | 0 | |
| | SRC | 0 | |

TABLE 4-continued

| | | | |
|---|---|---|---|
| | WRR | | Gripper off |
| | LDM | 1 | |
| | FiM | 0, X'30' | |
| | SRC | 0 | |
| | WRR | | $K_1$ on |
| C002 | JMS | POS J | |
| | XCH | X'F' | |
| | RAR | | |
| | JNC | C002 | HAL4 ? |
| C003 | JMS | POS | |
| | XCH | S'F' | |
| | RAL | | |
| | RAL | | |
| | JNC | C003 | HAL2(Print) ? |
| | LDM | 0 | |
| | FiM | 0, X'30' | |
| | SRC | 0 | |
| | WRR | | $K_1$ off |
| | JMS | PH5 | |
| | RAR | | |
| | RAR | | |
| | JC | MJAM | |
| | JUN | A001 | |
| POS J | FiM | 0, X'40' | |
| | SRC | 0 | |
| | RDR | | |
| | XCH | X'F' | |
| | BBL | 0 | |
| MASTER SEPARATION | | | |
| | A003 | | |
| | FiM | 0, X'30' | |
| | SRC | 0 | |
| | LDM | 1 | |
| | WRR | | $K_1$ on |
| d001 | JMS | POS | |
| | XCH | S'F' | |
| | RAL | | |
| | RAL | | |
| | JNC | d001 | |
| | LDM | 2 | |
| | SRC | 0 | |
| | WRR | | $K_2$ on $K_1$ off |
| | FiM | 0, X'80' | |
| | SRC | 0 | |
| | LDM | 0 | |
| | WRR | | LED7 off |
| | FiM | 0, X'60' | |
| | SRC | 0 | |
| | LDM | 2 | |
| | WRR | | LED2 on |
| d002 | JMS | POS | |
| | XCH | X'F' | |
| | RAL | | |
| | RAL | | |
| | JC | d002 | |
| d003 | JMS | POS | |
| | XCH | X'F' | |
| | RAL | | |
| | RAL | | |
| | JNC | d003 | |
| | LDM | 6 | |
| | FiM | 0, X'40' | |
| | SRC | 0 | |
| | WRR | | SOL4, 5 on |
| d004 | JMS | POS | |
| | XCH | X'F' | |
| | RAR | | |
| | RAR | | |
| | JNC | d004 | |
| | LDM | 0 | |
| | FiM | 0, X'30' | |
| | SRC | 0 | |
| | WRR | | $K_2$ off |
| | JMS | PH5 | |
| | JC | MJAM | |
| | JMS | US2 | |
| | JNC | MJAM | |
| | JUN | A002 | |

What we claim is:

1. An automatic printing apparatus comprising a recording medium, printing means including a plurality of elements for forming an image on the recording medium, means for instructing the starting and stopping of operation of the apparatus, means for detecting an operational status of the apparatus, a plurality of visual indicating elements for indicating functions of said elements, digital control means coupled to said detecting means and to said instructing means for controlling the sequence of operations of said plurality of image forming elements and the display operation of said visual indicating elements, and digital control means including a memory having a stored program for controlling energization of said image forming elements in accordance with said starting and stopping instructions and the detected operational status of the apparatus, wherein said digital control means is provided with first and second independent outputs coupled respectively to said image forming elements and said visual indicating means.

2. An automatic printing apparatus according to claim 1, wherein said digital control means controls the operation of said visual indicating means to provide a display in response to sequential operation of said image forming elements and a predetermined operation of said detecting means.

3. Printing apparatus operable for carrying out a multiple printing process to produce a plurality of identical images comprising:

means for setting the number of images to be produced in said process, image forming means operable for carrying out a plurality of successive different operations in the performance of said process, digital control means which includes memory means having stored therein a program defining a sequence in which said operations are to be carried out, said control means being operable to control said forming means in accordance with said program and with the number set by said setting means, a plurality of visual indicating elements each associated with a respective different one of said operations and controlled by said control means to indicate when the respective operation is carried out, wherein said digital control means is provided with first and second outputs coupled respectively to said forming means and said visual indicating elements.

4. Printing apparatus according to any one of claims 1, 2, wherein said digital control means comprises a microcomputer including at least one output port which provides a plurality of parallel bits, the state of each indicating element being controlled by a respective said bit.

5. An apparatus according to claim 1, wherein said outputs generate latch signals respectively to said image forming means and said indicating elements.

6. An apparatus according to claim 1, wherein said control means deactuates one of said indicating elements and actuates another one of said indicating elements in response to an output from said detecting means.

7. An apparatus according to claim 1, wherein said control means deactuates one of said indicating elements and actuates another one of said indicating elements in response to sequential operation of said image forming elements.

8. An apparatus according to claim 1, wherein said control means deactuates one of said indicating elements and actuates another one of said indicating elements in response to an instruction by said instruction means.

9. Printing apparatus according to claim 3 wherein the control means is coupled to control said visual indicating elements in accordance with the output of detector means arranged to respond to the successful performance of steps which constitute said operations.

10. Printing apparatus according to any one of claims 1, 2, or 3, further comprising means which respond to the jamming of a recording medium to cause the control means to stop the sequential operation of the visual indicating elements.

11. An apparatus according to claim 3, further comprising means for instructing the operation of the apparatus and means for detecting an operational status of the apparatus, which are connected with said control means.

12. An apparatus according to claim 1, wherein one of said image forming elements is a movable member, said detecting means detects the position of said movable member, and said control means controls one of said indicating elements in response to an output from said detecting means.

13. An automatic printing apparatus comprising a recording medium, printing means including a plurality of elements for forming an image on the recording medium, means for detecting an operational status of the apparatus, a plurality of visual indicating elements associated with a respective one of said image forming elements, digital control means coupled to said detecting means for controlling the sequence of operations of said plurality of image forming elements and the display operation of said visual indicating elements, said digital control means including a memory having a stored program for controlling energization of said image forming elements in accordance with the detected operational status of the apparatus, wherein said digital control means is provided with first and second independent outputs coupled respectively to said image forming elements and said visual indicating elements, and wherein said digital control means comprises a microcomputer including at least one of output ports which provides a plurality of parallel bits, the state of each indicating element being controlled by a respective said bit.

14. An apparatus according to claim 13, wherein said output port generates a latch signal which is coupled to said indicating elements.

15. An apparatus according to claim 13, wherein one of said image forming elements is a movable member, said detecting means detects the position of said movable member, and said control means controls one of said indicating elements in response to an output from said detecting means.

16. An apparatus according to claim 13, wherein said control means deactuates one of said indicating elements and actuates another one of said indicating elements in response to an output from said detecting means.

17. An apparatus according to claim 13, wherein said control means deactuates one of said indicating elements and actuates another one of said indicating elements in response to sequential operation of said image forming elements.

18. An apparatus according to claim 13, wherein manual means for instructing the operation of the apparatus is provided and said control means deactuates one of said indicating elements and actuates another one of said indicating elements in response to an instruction by said instruction means.

19. An automatic printing apparatus comprising a recording medium, printing means including a plurality of elements for forming an image on the recording medium, means for instructing the starting and stopping of operation of the apparatus, means for detecting an operational status of the apparatus, a plurality of visual indicating elements for indicating functions of said elements, digital control means coupled to said detecting means and to said instructing means for controlling the sequence of operations of said plurality of image forming elements and the display operation of said visual indicating elements, and digital control means including a memory having a stored program for controlling energization of said image forming elements in accordance with said starting and stopping instructions and the detected operational status of the apparatus, wherein said digital control means is provided with first and second independent outputs coupled respectively to said image forming elements and said visual indicating means and wherein said digital control means comprises a microcomputer including at least one output port which provides a plurality of parallel bits, the state of each indicating element being controlled by a respective said bit.

20. Printing apparatus operable for carrying out a multiple printing process to produce a plurality of identical images comprising:

means for setting the number of images to be produced in said process, image forming means operable for carrying out a plurality of successive different operations in the performance of said process, digital control means which includes memory means having stored therein a program defining a sequence in which said operations are to be carried out, said control means being operable to control said forming means in accordance with said program and with the number set by said setting means, and a plurality of visual indicating elements each associated with a respective different one of said operations and controlled by said control means to indicate when the respective operation is carried out;

wherein the control means is coupled to control said visual indicating elements in accordance with the output of detector means arranged to respond to the successful performance of steps which constitute said operations, and wherein said digital control means comprises a microcomputer including at least one output port which provides a plurality of parallel bits, the state of each indicating element being controlled by a respective said bit.

21. Printing apparatus operable for carrying out a multiple printing process to produce a plurality of identical images comprising:

means for setting the number of images to be produced in said process, image forming means operable for carrying out a plurality of successive different operations in the performance of said process, digital control means which includes memory means having stored therein a program defining a sequence in which said operations are to be carried out, said control means being operable to control said forming means in accordance with said program and with the number set by said setting means, and a plurality of visual indicating elements each associated with a respective different one of said operations and controlled by said control means to indicate when the respective operation is carried out;

wherein said digital control means is provided with first and second outputs coupled respectively to said forming means and said visual indicating elements, and wherein said digital control means comprises a microcomputer including at least one output port which provides a plurality of parallel bits, the state of each indicating element being controlled by a respective said bit.

22. Printing apparatus operable for carrying out a multiple printing process to produce a plurality of identical images comprising:

means for setting the number of images to be produced in said process, image forming means operable for carrying out a plurality of successive different operations in the performance of said process, digital control means which includes memory means having stored therein a program defining a sequence in which said operations are to be carried out, said control means being operable to control said forming means in accordance with said program and with the number set by said setting means, and a plurality of visual indicating elements each associated with a respective different one of said operations and controlled by said control means to indicate when the respective operation is carried out;

wherein said digital control means is provided with first and second outputs coupled respectively to said forming means and said visual indicating elements, and wherein said outputs generate latch signals respectively to said image forming means and said indicating elements.

23. Printing apparatus operable for carrying out a multiple printing process to produce a plurality of identical images comprising:

means for setting the number of images to be produced in said process, image forming means operable for carrying out a plurality of successive different operations in the performance of said process, digital control means which includes memory means having stored therein a program defining a sequence in which said operations are to be carried out, said control means being operable to control said forming means in accordance with said program and with the number set by said setting means, a plurality of visual indicating elements each associated with a respective different one of said operations and controlled by said control means to indicate when the respective operation is carried out, and means for instructing the operation of the apparatus and means for detecting an operational status of the apparatus, which are connected with said control means, wherein one of said image forming elements is a movable member, said detecting means detects the position of said movable member, and said control means controls one of said indicating elements in response to an output from said detecting means.

24. Printing apparatus operable for carrying out a multiple printing process to produce a plurality of identical images comprising:

means for setting the number of images to be produced in said process, image forming means operable for carrying out a plurality of successive different operations in the performance of said process, digital control means which includes memory means having stored therein a program defining a sequence in which said operations are to be carried out, said control means being operable to control said forming means in accordance with said program and with the number set by said setting means, a plurality of visual indicating elements each associated with a respective different one of said operations and controlled by said control means to indicate when the respective operation is carried out, and means for instructing the operation of the apparatus and means for detecting an operational status of the apparatus, which are connected with said control means, wherein said control means deactuates one of said indicating elements and actuates another one of said indicating elements in response to an output from said detecting means.

25. Printing apparatus operable for carrying out a multiple printing process to produce a plurality of identical images comprising:

means for setting the number of images to be produced in said process, image forming means operable for carrying out a plurality of successive different operations in the performance of said process, digital control means which includes memory means having stored therein a program defining a sequence in which said operations are to be carried out, said control means being operable to control said forming means in accordance with said program and with the number set by said setting means, and a plurality of visual indicating elements each associated with a respective different one of said operations and controlled by said control means to indicate when the respective operation is carried out, wherein said control means deactuates one of said indicating elements and actuates another one of said indicating elements in response to sequential operation of said image forming elements.

26. Printing apparatus operable for carrying out a multiple printing process to produce a plurality of identical images comprising:

means for setting the number of images to be produced in said process, image forming means operable for carrying out a plurality of successive different operations in the performance of said process, digital control means which includes memory means having stored therein a program defining a sequence in which said operations are to be carried out, said control means being operable to control said forming means in accordance with said program and with the number set by said setting means, a plurality of visual indicating elements each associated with a respective different one of said operations and controlled by said control means to indicate when the respective operation is carried out, and means for instructing the operation of the apparatus and means for detecting an operational status of the apparatus, which are connected with said control means, wherein said control means deactuates one of said indicating elements and actuates another one of said indicating elements in response to an instruction by said instruction means.

* * * * *

UNITED STATES PATENT AND TRADEMARK OFFICE

CERTIFICATE OF CORRECTION

PATENT NO. : 4,464,043

DATED : August 7, 1984

INVENTOR(S) : NOBORU KOUMURA, ET AL.

It is certified that error appears in the above-identified patent and that said Letters Patent is hereby corrected as shown below:

IN THE ABSTRACT

Line 16, before "visualizing" insert --for--.

COLUMN 4

Line 8, after "automatic" insert --printing--.

COLUMN 13

Line 57, after "fixed" insert --image--.

COLUMN 15

Line 13, after "free" insert --radial--.

COLUMN 16

Line 6, "detailedly" should read --is--.

COLUMN 17

Line 31, "at" should read --to--.

COLUMN 18

Line 19, before "PH2" (first occurrence) insert --at--.

COLUMN 19

Line 18, "MS" should read --MRS--.

Line 47, "a L-level" should read --an L-level--.

COLUMN 21

Line 8, "an" should read --and--.

UNITED STATES PATENT AND TRADEMARK OFFICE

CERTIFICATE OF CORRECTION

PATENT NO. : 4,464,043

DATED : August 7, 1984

INVENTOR(S) : NOBORU KOUMURA, ET AL.

It is certified that error appears in the above-identified patent and that said Letters Patent is hereby corrected as shown below:

COLUMN 24

Line 32, "S'F'" should read --X'F'--.

Signed and Sealed this

*Fourteenth* Day of *May 1985*

[SEAL]

*Attest:*

DONALD J. QUIGG

*Attesting Officer* *Acting Commissioner of Patents and Trademarks*